US008668300B2

(12) United States Patent
Samoto et al.

(10) Patent No.: US 8,668,300 B2
(45) Date of Patent: Mar. 11, 2014

(54) IMAGE RECORDING APPARATUS

(75) Inventors: Kenji Samoto, Nagoya (JP); Yuji Koga, Nagoya (JP); Keisuke Wakakusa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 40 days.

(21) Appl. No.: 13/072,753

(22) Filed: Mar. 27, 2011

(65) Prior Publication Data

US 2011/0310145 A1 Dec. 22, 2011

(30) Foreign Application Priority Data

Jun. 17, 2010 (JP) ..... 2010-138806

(51) Int. Cl.

| | |
|---|---|
| ***B41J 29/38*** | (2006.01) |
| *B41J 2/01* | (2006.01) |
| *B65H 5/22* | (2006.01) |
| *B65H 83/00* | (2006.01) |
| *B65H 85/00* | (2006.01) |
| *B65H 3/44* | (2006.01) |
| *B65H 5/26* | (2006.01) |
| *B65H 5/00* | (2006.01) |
| *B65H 9/00* | (2006.01) |
| *B65H 7/02* | (2006.01) |

(52) U.S. Cl.

USPC ..... 347/16; 347/101; 347/104; 271/3.14; 271/3.17; 271/9.01; 271/10.01; 271/226; 271/227; 271/258.01; 271/259

(58) Field of Classification Search

USPC ..... 347/101, 104, 16; 271/3.14, 3.17, 9.01, 271/10.01, 226, 227, 258.01, 259

See application file for complete search history.

(56) References Cited

U.S. PATENT DOCUMENTS 4,990,011 A * 2/1991 Underwood et al. ..... 400/636
5,222,724 A * 6/1993 Hirano et al. ..... 271/10.11

(Continued)

FOREIGN PATENT DOCUMENTS

CN 1935522 A 3/2007
CN 101314287 A 12/2008

(Continued)

OTHER PUBLICATIONS

State Intellectual Property Office of the People's Republic of China, Notification of First Office Action for Chinese Patent Application No. 201110080135.X (counterpart to above-captioned patent application), mailed Jul. 9, 2013.

(Continued)

*Primary Examiner* — Laura Martin
*Assistant Examiner* — Jeremy Bishop
(74) *Attorney, Agent, or Firm* — Baker Botts L.L.P.

(57) ABSTRACT

A multifunction machine includes: a first feeding roller and a second feeding roller; an intermediate roller pair provided to a curved portion of a transport route; a main transporting roller pair; a recording head; a first drive motor and a second drive motor; and a control section. The control section intermittently drives the main transporting roller pair and makes the recording head jet ink during a period of time in which the main transporting roller pair is stopped, and performs pre-paper feeding processing for rotating the first feeding roller a predetermined amount in a paper feeding direction when a rear end of a paper is positioned between a first sensor and the first feeding roller.

14 Claims, 18 Drawing Sheets

(56) References Cited

U.S. PATENT DOCUMENTS

| | | | | |
|---|---|---|---|---|
| 7,451,975 | B2 | 11/2008 | Cook | |
| 7,731,175 | B2 * | 6/2010 | Kang | 271/110 |
| 7,959,147 | B2 * | 6/2011 | Izuchi et al. | 271/9.02 |
| 8,033,541 | B2 * | 10/2011 | Akiyama et al. | 271/10.03 |
| 8,047,529 | B2 * | 11/2011 | Fukasawa | 271/10.03 |
| 8,152,161 | B2 * | 4/2012 | Samoto et al. | 271/186 |
| 2007/0063429 | A1 | 3/2007 | Kang | |
| 2007/0291071 | A1 | 12/2007 | Nakazawa et al. | |
| 2008/0024576 | A1 | 1/2008 | Kim | |
| 2008/0157460 | A1 * | 7/2008 | Izuchi et al. | 271/109 |
| 2008/0296836 | A1 | 12/2008 | Akiyama et al. | |
| 2009/0166963 | A1 | 7/2009 | Fukasawa | |

FOREIGN PATENT DOCUMENTS

| | | | |
|---|---|---|---|
| CN | 101468558 | A | 7/2009 |
| JP | 2003-034454 | A | 2/2003 |
| JP | 2008-018711 | A | 1/2008 |

OTHER PUBLICATIONS

The State Intellectual Property Office of the People'S Republic of China, Notification of Second Office Action for Chinese Patent Application No. 201110080135.X (counterpart to above-captioned patent application), mailed Jan. 8, 2014.

* cited by examiner

IMAGE RECORDING APPARATUS

CROSS REFERENCE TO RELATED APPLICATION

The present application claims priority from Japanese Patent Application No. 2010-138806, filed on Jun. 17, 2010, the disclosure of which is incorporated herein by reference in its entirety.

BACKGROUND OF THE INVENTION

1. Field of the Invention

The present invention relates to an image recording apparatus transporting a sheet-shaped recording medium and performing recording of an image by jetting ink onto the transported recording medium.

2. Description of the Related Art

Conventionally, there has been provided an image recording apparatus including: a mounting section on which a sheet-shaped recording medium such as a recording paper is mounted; a feeding roller feeding the recording medium from the mounting section; a main transporting roller pair nipping and transporting the recording medium fed by the feeding roller; and a recording head jetting ink onto the recording medium transported by the main transporting roller pair. As an example of this type of image recording apparatus, there can be cited a printer, a copying machine, a multifunction machine having printing, scanning, copying and faxing functions and the like.

There is known an image recording apparatus that feeds, in parallel with a printing operation of a recording medium precedently fed by a feeding roller, the following recording medium from a mounting section. An image recording apparatus described in Japanese Patent Application Laid-open No. 2003-34454 feeds the following recording medium mounted on a mounting section by driving a paper feeding roller, when a sensor detects a rear end of a recording medium on which printing is performed. For this reason, it is possible to reduce a period of time required for image recording, and thus it becomes possible to perform high-speed image recording.

Further, in the aforementioned image recording apparatus, in order to correct a skew of the transported recording medium, an operation as described below is performed. First, a tip of the recording medium fed by a feeding roller is once passed through a skew correction roller pair. After that, return register in which the feeding roller is rotated in a direction opposite to a transport direction of the skew correction roller pair to make the recording medium abut on the skew correction roller pair is executed, and thereafter, the feeding roller is rotated in the transport direction of the skew correction roller pair. Specifically, the aforementioned image recording apparatus performs so-called register correction to correct the skew of the recording medium, and performs image recording in which a recording position is highly accurate.

SUMMARY OF THE INVENTION

In the aforementioned image recording apparatus, although it is possible to achieve high accuracy of the recording position in the image recording, a period of time required for the image recording is increased by a period of time for executing the register correction on the recording medium using the skew correction roller pair. Further, the feeding of recording medium on which the image is recorded next is not carried out until when the rear end of the precedently fed recording medium is detected by the sensor. Accordingly, a distance between the recording media becomes large depending on a disposed position of the sensor, resulting in that the period of time required for the image recording is increased. Namely, in the aforementioned image recording apparatus, achievement of high accuracy of the recording position in the image recording and speed-up of the image recording are in a relation of tradeoff, and thus they cannot be realized at the same time.

The present invention has an object to reduce a period of time required for image recording without lowering an accuracy of recording position in the image recording performed on a recording medium.

According to an aspect of the present invention, there is provided an image recording apparatus which jets an ink to record an image on sheet-shaped recording media, including:

a first mounting section on which the sheet-shaped recording media are mounted;

a first feeding roller which feeds one recording medium of the recording media from the first mounting section;

a first transporting roller pair which nips the recording medium fed by the first feeding roller to transport the recording medium in a transport direction;

a second transporting roller pair which is provided on a downstream side of the first transporting roller pair in the transport direction, and which nips and transports the recording medium transported by the first transporting roller pair;

a recording head which is provided on a downstream side of the second transporting roller pair in the transport direction and which jets the ink onto the recording medium transported by the second transporting roller pair;

a first detecting section which is provided on an upstream side of the first transporting roller pair in the transport direction and which detects the recording medium passing through thereof to output a first output and a second output, the first output being output during when the recording medium passes through the first detecting section and the second output being output during when the recording medium does not pass through the first detecting section;

a driving section which drives the first paper feeding roller, the first transporting roller pair and the second transporting roller pair; and a controller which controls the driving section and the recording head.

The control section is structured to execute a first recording mode in which the first transporting roller pair is rotated in synchronization with a rotation of the second transporting roller pair, after performing a plurality kinds of processing of:

a recording processing in which the controller controls the driving section to drive the second transporting roller pair intermittently and controls the recording head to jet the ink during a period of time in which the second transporting roller pair is stopped;

a pre-paper feeding processing in which, during the recording processing, the controller controls the driving section so that the first feeding roller is rotated a predetermined amount in a paper feeding direction until when the output of the first detecting section is changed from the first output to the second output and that a tip of a following recording medium is fed to an upstream side of the first detecting section; and a first skew correction processing in which the controller controls the driving section to rotate the first feeding roller to make the following recording medium abut on the first transporting roller pair, under a condition that the output of the first detecting section is changed from the first output to the second output.

In the present invention, since the feeding of the following recording medium is started before the rear end of the precedently fed recording medium passes through the first detecting section, there is realized an image recording apparatus capable of reducing a period of time taken for the image recording. Further, since the skew of the following recording medium is corrected by performing register correction using the first transporting roller pair, and the following recording medium is transported toward the second transporting roller pair in synchronization with the operation of transporting the precedently fed recording medium, it is possible to practically eliminate a period of time required for the register correction, and as a result of this, it is possible to further reduce the period of time taken for the image recording without lowering an accuracy of recording position in the image recording.

DETAILED DESCRIPTION OF THE PREFERRED EMBODIMENTS

Figure 1:
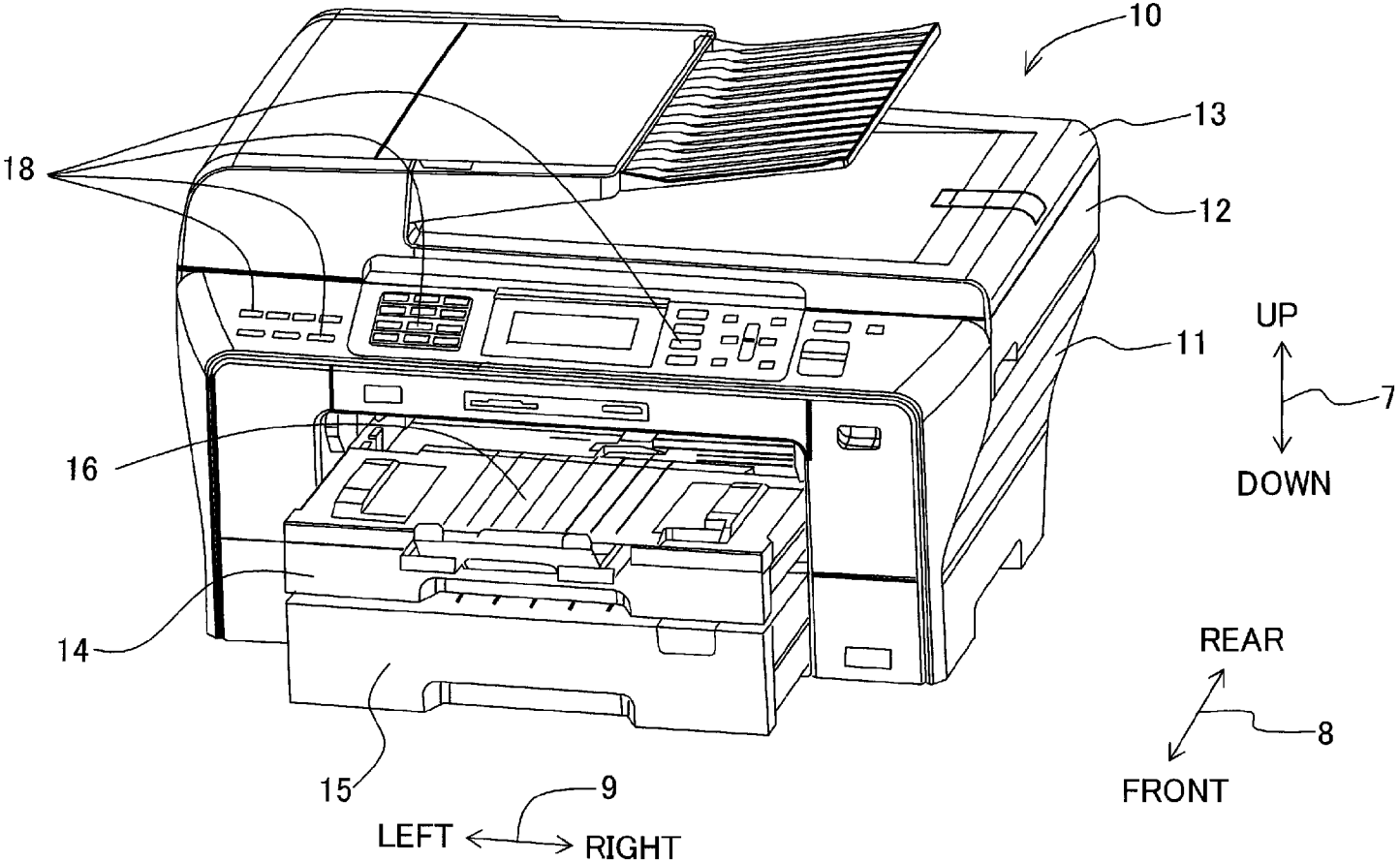
FIG. 1 is a perspective view of a multifunction machine.

Hereinafter, as an image recording apparatus of the present invention, a multifunction machine 10 as shown in FIG. 1 having printing, scanning, copying and faxing functions and the like will be explained. The multifunction machine 10 is formed almost in a rectangular parallelepiped shape. In the description hereinbelow, a height direction, a depth direction, and a width direction of the multifunction machine 10 are defined as an up-down direction 7, a front-rear direction 8, and a left-left-right direction 9, respectively.

<Outline of Multifunction Machine 10>

Figure 2:
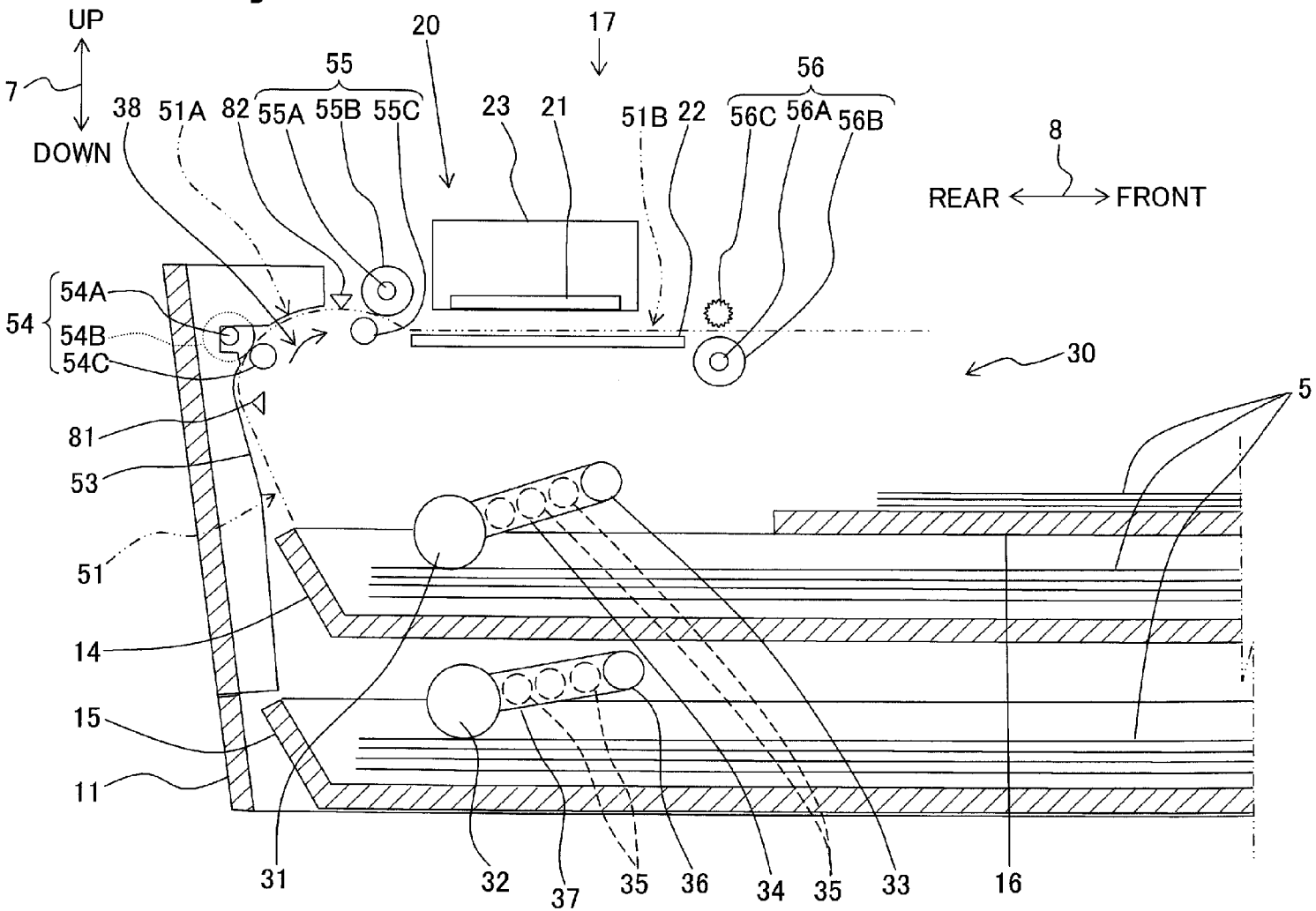
FIG. 2 is a schematic sectional view of a printer unit.

The multifunction machine 10 includes: a printer housing 11; a scanner housing 12 which is disposed above the printer housing 11 and which houses a scanner unit; and an original cover 13 which is disposed above the scanner housing 12. The printer housing 11 houses, in a lower portion thereof, an upper tray 14 and a lower tray 15 on which a paper 5 such as a plain paper, a glossy paper, a postcard and the like is mounted, in a manner that the trays can be forwardly pulled out. The printer housing 11 houses, in an upper portion thereof, a printer unit 17 as shown in FIG. 2 that records an image on the paper 5. A paper discharge tray 16 is mounted on the upper tray 14. The upper tray 14 corresponds to a first mounting section in the present teaching, the lower tray 15 corresponds to a second mounting section in the present teaching, and the paper 5 corresponds to a recording medium in the present teaching.

Figure 9:
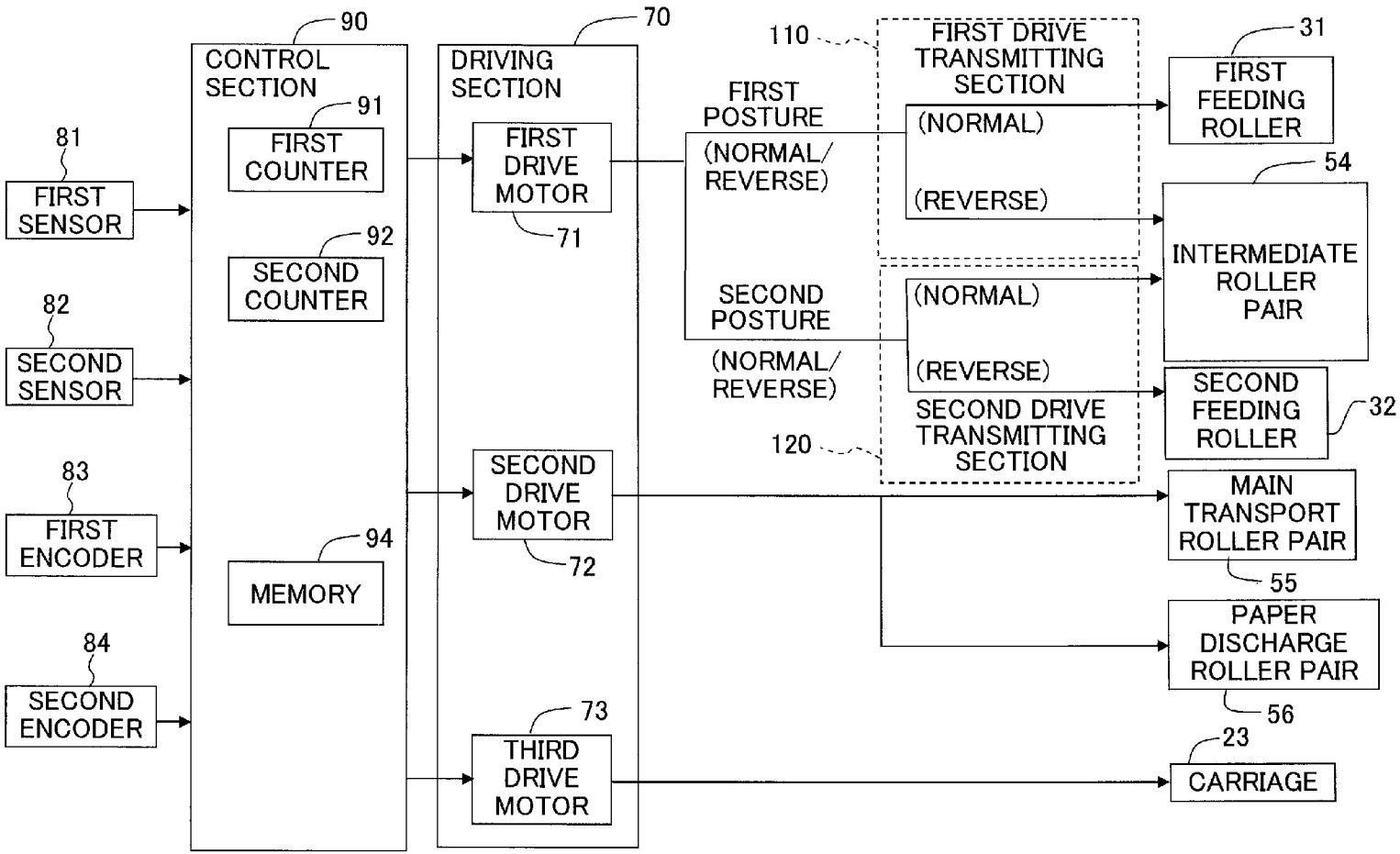
FIG. 9 is a block diagram of the present embodiment.

The scanner unit and the printer unit 17 is controlled by a control section 90 shown in FIG. 9. The control section 90 is realized by, for example, various electronic components such as a microcomputer mounted on a substrate. The control section 90 controls the scanner unit and the printer unit to perform scanning of images and recording of images, respectively, based on a signal input through a plurality of input buttons 18 shown in FIG. 1 or based on a signal input from an external device such as a personal computer. The control section 90 will be described later in detail. The control section 90 corresponds to a controller in the present teaching.

<Printer Unit 17>

As shown in FIG. 2, the printer unit 17 includes: a transporting device 30 transporting the paper 5 mounted on the upper tray 14 and the lower tray 15; a recording section 20 recording an image on the paper 5 transported by the transporting device 30; a driving section 70 (refer to FIG. 9) and a drive transmission switching mechanism 40 (refer to FIG. 3); and a later-described detecting mechanism formed of a first sensor 81 and the like.

<Recording Section 20>

As shown in FIG. 2, the recording section 20 includes: a plate-shaped platen 22 disposed above a rear portion of the upper tray 14; a recording head 21 disposed opposite to and above the platen 22; and a carriage 23 holding the recording head 21 (refer to FIG. 9). The recording head 21 corresponds to a recording head in the present teaching.

A plurality of nozzles which are not shown are formed on the recording head 21. Each nozzle has a jetting port opening downward. For instance, when a pressure is applied to ink because of a deformation of a piezoelectric element, an ink droplet is jetted toward the platen 22 located below the recording head 21 from the jetting port. A power is supplied to the piezoelectric element by using a flexible cable or the like, and is controlled by the control section 90.

The carriage 23 is disposed so as to straddle a pair of rail bodies 24 (refer to FIG. 3) disposed above the platen 22 in the front-rear direction. As described above, the carriage 23 is supported by the rail bodies 24 in a movable manner along the left-right direction 9. The rail bodies 24 are formed in a plate shape which are elongated in the left-left-right direction 9 and are supported by a frame 25. An abutting piece 26 (refer to FIG. 4) for performing gear switching in the drive transmission switching mechanism 40 is projecting in the right direction from a right end portion of the carriage 23.

<Transporting Device 30>

The transporting device 30 shown in FIG. 2 includes: a first feeding roller 31 which feeds the paper 5 mounted on the upper tray 14; a second feeding roller 32 which feeds the paper 5 mounted on the lower tray 15; a main transport route 51 through which the papers 5 fed by the first feeding roller 31 and the second feeding roller 32 are transported; and three roller pairs (an intermediate roller pair 54, a main transporting roller pair 55, and a paper discharge roller pair 56) which are provided to the main transport route 51 in an attached manner and which nip the papers 5 to transport.

<First Feeding Roller 31, Second Feeding Roller 32>

The first feeding roller 31 is disposed above a rear portion of the upper tray 14, and is supported by using an arm 34 and a rotary shaft 33 that is driven by the driving section 70 (refer to FIG. 9). The first feeding roller 31 is rotatably attached to one end portion of the arm 34, and the other end portion of the arm 34 is rotatably supported by the rotary shaft 33. Further, the arm 34 is provided with a plurality of transmission gears 35 which transmit a rotation (a rotational force) of the rotary shaft 33 to the first feeding roller 31.

When the arm 34 rotates around the rotary shaft 33, the first feeding roller 31 is brought into contact with the paper 5 mounted on the upper tray 14. A rotation of the rotary shaft 33 is transmitted to the first feeding roller 31 via the transmission gears 35. Accordingly, the first feeding roller 31 rotates, and the paper 5 with which the first feeding roller is brought into contact is fed in the upper direction from a rear wall of the upper tray 14. Similar to the first feeding roller 31, the second feeding roller 32 is supported by using a rotary shaft 36 and an arm 37. When the second feeding roller 32 rotates, the paper 5 mounted on the lower tray 15 is fed. The first feeding roller 31 corresponds to a first feeding roller in the present teaching, and the second feeding roller 32 corresponds to a second feeding roller in the present teaching.

<Main Transport Route 51>

The main transport route 51 is a so-called U-turn pass formed of a guide member 53 and the platen 22. The main transport route 51 includes a curved portion 51A having a cross-section formed in an arc shape and a linear portion 51B having a cross-section formed in a linear shape and passing between the platen 22 and the recording head 21. By providing the curved portion 51A, it is possible to dispose the recording section 20 above the upper tray 14, which allows the multifunction machine 10 to be compact in size. The main transport route 51 corresponds to a transport route in the present teaching, and the curved portion 51A corresponds to a curved portion in the present teaching.

One end of the main transport route 51 is positioned above the rear wall of the upper tray 14 and the other end thereof is positioned above the paper discharge tray 16. The paper 5 fed from the upper tray 14 or the lower tray 15 is transported on the platen 22 in a forward direction and is discharged to the paper discharge tray 16.

<Intermediate Roller Pair 54>

The intermediate roller pair 54 includes a plurality of driving rollers 54B fixed to a rotary shaft 54A rotated by the driving section 70 (refer to FIG. 9) and a driven roller 54C driven by the driving rollers 54B. The intermediate roller pair 54 is disposed so that an axial direction of the rotary shaft 54A is along the left-left-right direction 9 and the curved portion 51A passes through a nip position of the roller pair, and the intermediate roller pair 54 nips and transports the paper 5 fed from the upper tray 14 or the lower tray 15. The intermediate roller pair 54 corresponds to a first transporting roller pair in the present teaching.

<Main Transporting Roller Pair 55>

The main transporting roller pair 55 includes a plurality of driving rollers 55B fixed to a rotary shaft 55A rotated by the driving section 70 and a driven roller 55C driven by the driving rollers 55B. The main transporting roller pair 55 is disposed at a rear side of the platen 22 so that an axial direction of the rotary shaft 55A is along the left-left-right direction 9, and the main transporting roller pair 55 transports the paper 5 transported by the intermediate roller pair 54 in the forward direction. The main transporting roller pair 55 corresponds to a second transporting roller pair in the present teaching.

<Paper Discharge Roller Pair 56>

The paper discharge roller pair 56 includes a plurality of driving rollers 56B fixed to a rotary shaft 56A rotated by the driving section 70 and a driven roller 56C driven by the driving rollers 56B. The paper discharge roller pair 56 is disposed at a front side of the platen 22 so that an axial direction of the rotary shaft 56A is along the left-left-right direction 9, and the paper discharge roller pair 56 discharges the paper 5 transported by the main transporting roller pair 55 to the paper discharge tray 16.

<Driving Section 70>

As shown in FIG. 9, the driving section 70 includes a first drive motor 71, a second drive motor 72 and a third drive motor 73 capable of rotating in either normal (forward) or reverse direction. As each of the drive motors 71, 72 and 73, a DC motor is used, for example. The respective drive motors 71, 72 and 73 are disposed on the left side of the platen 22, and a power is supplied thereto from a not-shown power supply section. The control section 90 controls the driving of the respective drive motors 71, 72 and 73 by controlling the power supply from the power supply section to the respective drive motors 71, 72 and 73.

<First Drive Motor 71>

A driving force of the first drive motor 71 is transmitted to the first feeding roller 31, the second feeding roller 32, the intermediate roller pair 54 and a not-shown maintenance mechanism by the later-described drive transmission switching mechanism 40. The first drive motor 71 corresponds to a first drive motor in the present teaching.

<Second Drive Motor 72>

The second drive motor 72 has a shaft coupled, directly or via a gear, to the rotary shaft 55A of the main transporting roller pair 55, and drives the rotary shaft 55A. A driving force of the second drive motor 72 is transmitted to the rotary shaft 56A by a not-shown first belt transmission mechanism. The first belt transmission mechanism includes an endless belt. When the rotary shaft 55A is rotated by the second drive motor 72, the driving force of the second drive motor 72 is transmitted to the rotary shaft 56A by the first belt transmission mechanism, resulting in that the rotary shaft 56A is rotated together with the rotary shaft 55A. With the use of the second drive motor 72 and the first belt transmission mechanism, the main transporting roller pair 55 and the paper discharge roller pair 56 are simultaneously rotated in a direction of rotation in which the paper 5 is transported in the same transport direction 38. Regarding a direction of rotation of the second drive motor 72, it is defined that the paper 5 is transported in the transport direction 38 when the second drive motor 72 is rotated in the normal direction. The second drive motor 72 corresponds to a second drive motor in the present teaching. Further, the transport direction 38 corresponds to a transport direction in the present teaching.

<Third Drive Motor 73>

A driving force of the third drive motor 73 is transmitted to the carriage 23 by a not-shown second belt transmission mechanism, which makes the carriage 23 move along the left-right direction 9. The second belt transmission mechanism includes, for example, an endless belt to which the carriage 23 is fixed. When the belt is rotated by the third drive motor 73, the carriage 23 moves in the left direction or the right direction in accordance with the rotation of the belt.

<Drive Transmission Switching Mechanism 40>

Figure 3:
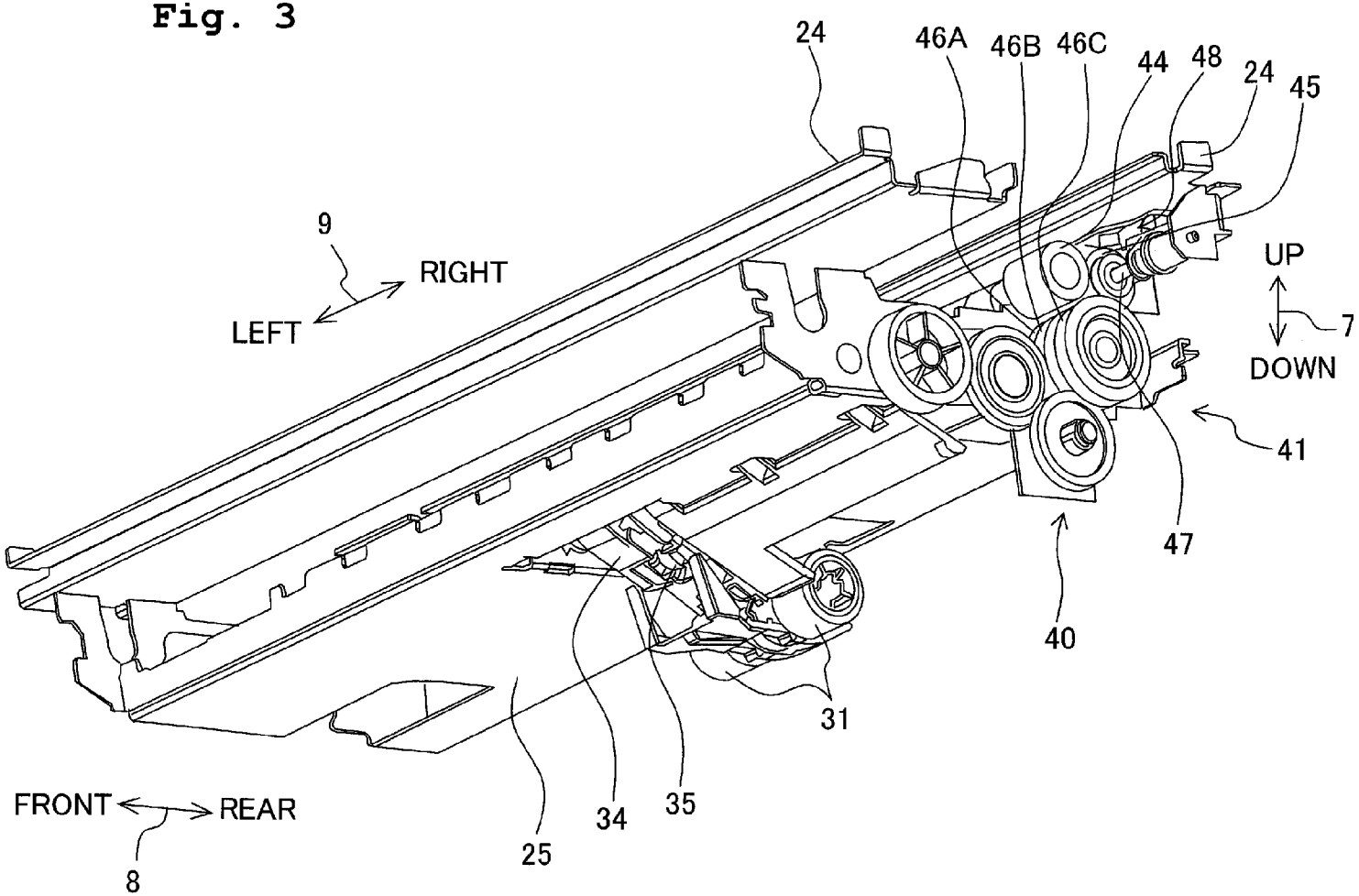
FIG. 3 is a perspective view of a drive transmission switching mechanism.

The drive transmission switching mechanism 40 shown in FIG. 3 includes: a gear switching mechanism 41; a first drive transmitting section 110 (refer to FIG. 12) which transmits a driving force switched by the gear switching mechanism 41 to the first feeding roller 31 or the intermediate roller pair 54; and a second drive transmitting section 120 (refer to FIG. 13) which transmits a driving force switched by the gear switching mechanism 41 to the second feeding roller 32 or the intermediate roller pair 54. The drive transmission switching mechanism 40 is disposed on the right side of the platen 22. The drive transmission switching mechanism 40 corresponds to a drive transmission switching mechanism in the present teaching, the first drive transmitting section 110 corresponds to a first drive transmitting section in the present teaching, and the second drive transmitting section 120 corresponds to a second drive transmitting section in the present teaching.

<Gear Switching Mechanism 41>

Figure 4:
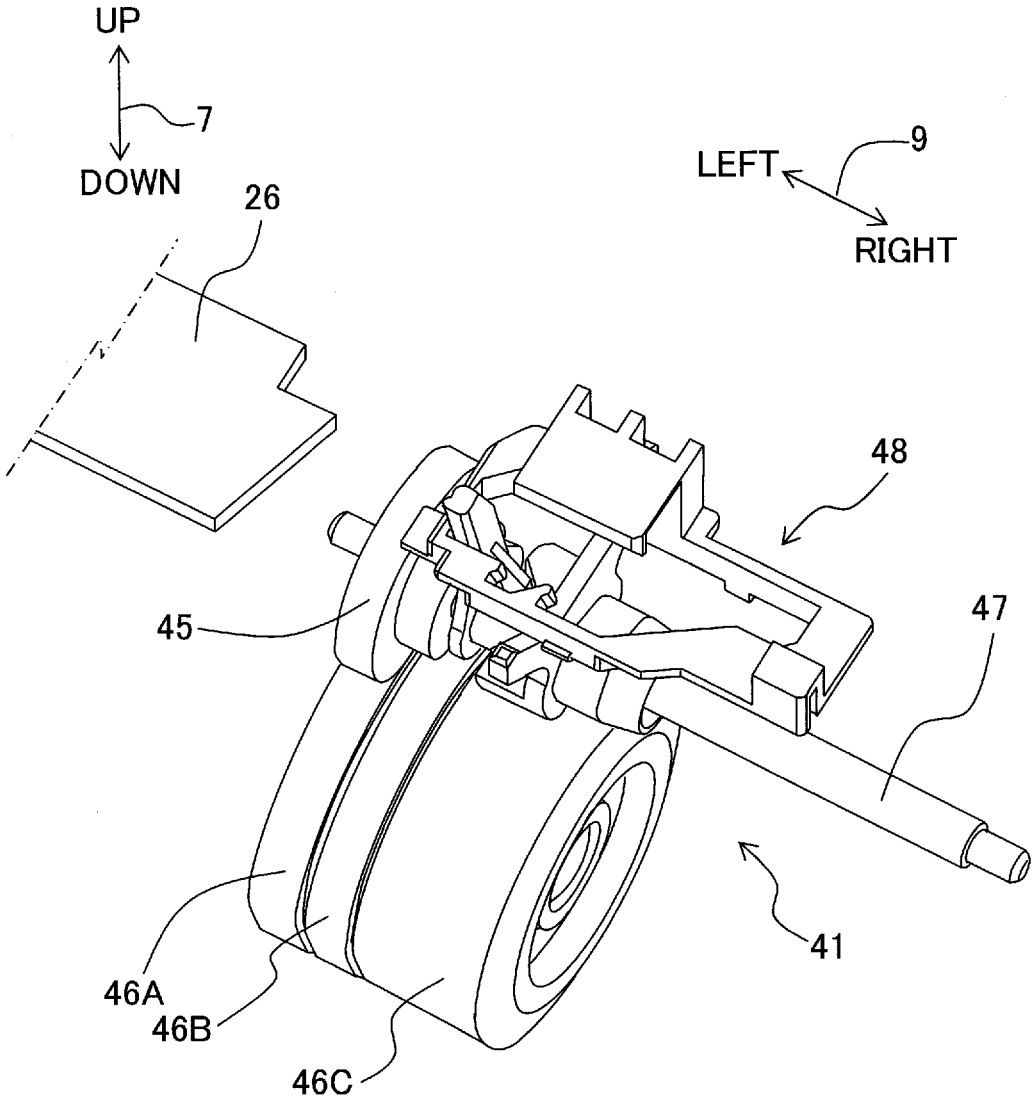
FIG. 4 is a perspective view of a gear switching mechanism in a first posture.

As shown in FIGS. 3 to 5, the gear switching mechanism 41 includes: a drive gear 44 which is driven by the first drive motor 71; a switching gear 45; a first receiving gear 46A, a second receiving gear 46B and a third receiving gear 46C each of which has teeth capable of engaging with the switching gear 45; and a holding mechanism 48 which holds the switching gear 45.

<Drive Gear 44, Switching Gear 45>

A supporting shaft 47 is disposed substantially parallel to a rotation axis of the drive gear 44, and the supporting shaft 47 is inserted through the switching gear 45. The switching gear 45 can rotate around an axis of the supporting shaft 47 and can also move along an axial direction of the supporting shaft 47 (left-right direction 9). The switching gear 45 is formed to have a width dimension (dimension in the left-right direction 9) smaller than a width dimension of the drive gear 44. By moving in the left-right direction 9 within a range of the aforementioned width dimension, the switching gear 45 changes its posture to a first posture, a second posture and a third posture. The switching gear 45 engages with the drive gear 44 in any of the postures. A posture in which the switching gear 45 engages with a left end portion of the drive gear 44 is set to the first posture, and a posture in which the switching gear 45 engages with a right end portion of the drive gear 44 is set to the third posture. When the switching gear 45 moves in the right direction, the posture is changed in the order of the first posture in FIG. 4, the second posture in FIG. 5A and the third posture in FIG. 5B. The drive gear 44 corresponds to a first gear in the present teaching, and the switching gear 45 corresponds to a second gear in the present teaching. Further, the first posture of the switching gear 45 corresponds to a first posture in the present teaching, and the second posture of the gear corresponds to a second posture in the present teaching.

<Holding Mechanism 48>

Figure 5A:
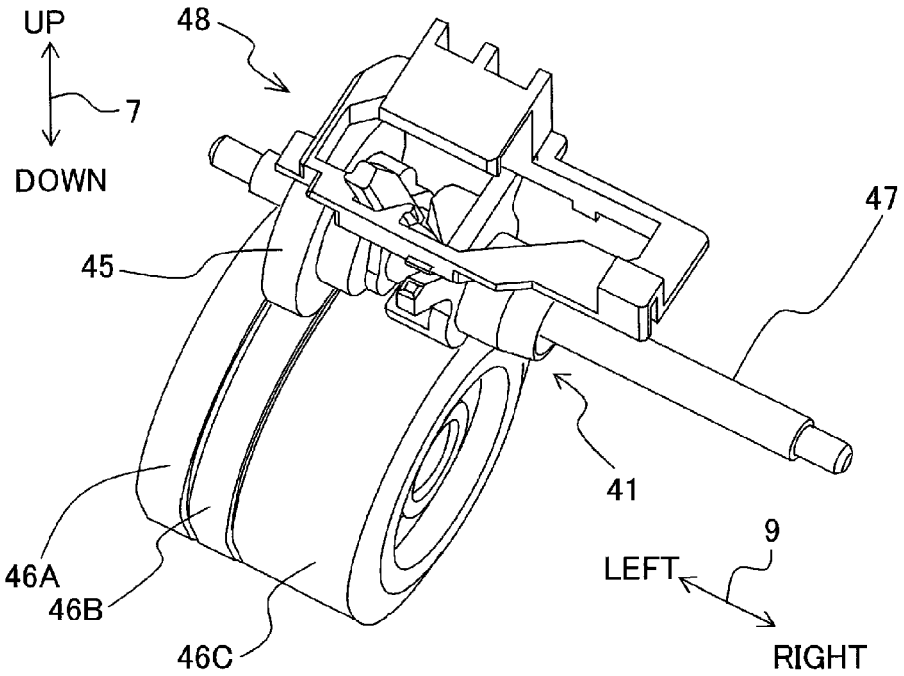
FIG. 5A is a perspective view of the gear switching mechanism in a second posture.
Figure 5B:
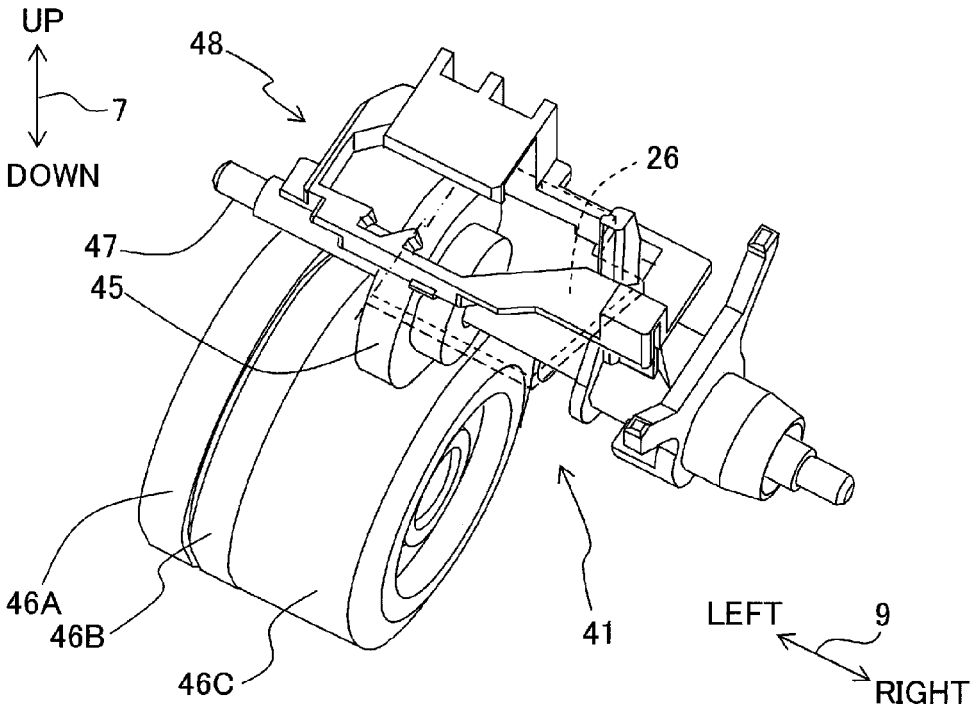
FIG. 5B is a perspective view of the gear switching mechanism in a third posture.

The holding mechanism 48 has a function that it holds the switching gear 45 in the first posture in FIG. 4 and the second posture in FIG. 5A changed from the first posture, and it does not hold the switching gear 45 in the third posture in FIG. 5B and the second posture changed from the third posture. Further, the holding mechanism 48 has a function to change the posture of the switching gear 45 to the first posture, the second posture and the third posture when it is pushed from the left side by the aforementioned abutting piece 26 provided to the carriage 23.

<First Receiving Gear 46A, Second Receiving Gear 46B and Third Receiving Gear 46C>

As shown in FIGS. 4 and 5, the first receiving gear 46A, the second receiving gear 46B and the third receiving gear 46C are formed to have the mutually same diameter, and are disposed in a manner that rotation axes thereof lie on a straight line along the axial direction of the supporting shaft 47. Further, the first receiving gear 46A is disposed at a position at which it engages with the switching gear 45 in the first posture, the second receiving gear 46B is disposed at a position at which it engages with the switching gear 45 in the second posture, and the third receiving gear 46C is disposed at a position at which it engages with the switching gear 45 in the third posture. The switching gear 45 has a function that it engages with any one of the first receiving gear 46A, the second receiving gear 46B and the third receiving gear 46C, and selects any one of the first receiving gear 46A, the second receiving gear 46B and the third receiving gear 46C to rotate the selected gear. Note that the third receiving gear 46C is provided for driving the not-shown maintenance mechanism. Here, the maintenance mechanism corresponds to a maintenance mechanism that executes maintenance of the recording head 21, for instance. The first receiving gear 46A corresponds to a third gear in the present teaching, and the second receiving gear 46B corresponds to a fourth gear in the present teaching.

<First Drive Transmitting Section 110>

Figure 12:
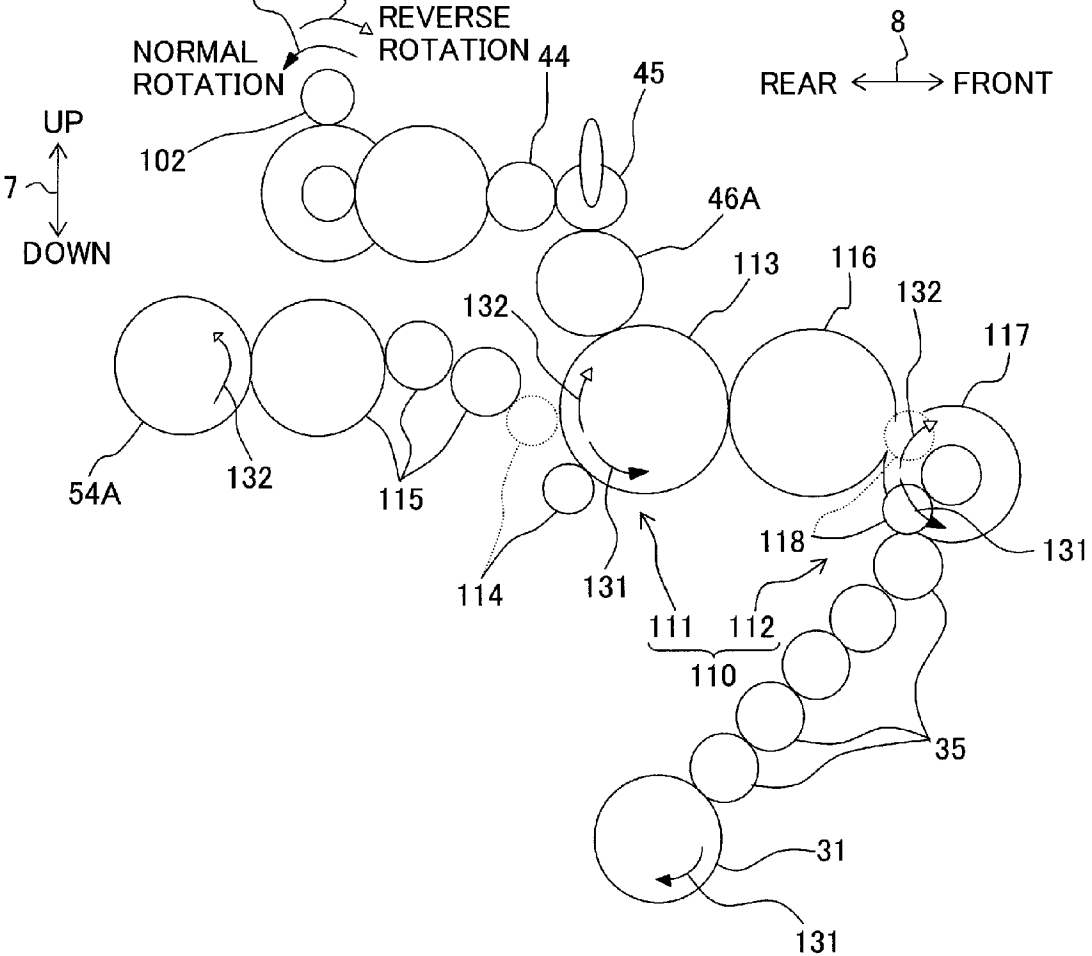
FIG. 12 is a schematic diagram of a first drive transmitting section.

As shown in FIG. 12, the first drive transmitting section 110 includes a first planetary gear mechanism 111 and a second planetary gear mechanism 112. The first planetary gear mechanism 111 includes a sun gear 113 that engages with the first receiving gear 46A, and a planet gear 114 that rotates while revolving around the sun gear 113. When the first drive motor 71 is reversely rotated (refer to an arrow mark 132), the planet gear 114 engages with one of a plurality of transmission gears 115 which transmit the rotation to the rotary shaft 54A of the intermediate roller pair 54 (refer to the planet gear 114 indicated by a dotted line). The second planetary gear mechanism 112 includes a sun gear 117 to which a rotation of the sun gear 113 is transmitted by a transmission gear 116, and a planet gear 118 that rotates while revolving around the sun gear 117. When the first drive motor 71 is rotated in the normal direction (refer to an arrow mark 131), the planet gear 118 engages with one of the plurality of transmission gears 35 which transmit the rotation to the first feeding roller 31 (refer to the planet gear 118 indicated by a solid line). With the structure described above, the first drive transmitting section 110 has a function to transmit the driving force of the normally-rotated first drive motor 71 to the first feeding roller 31 and to transmit the driving force of the reversely-rotated first drive motor 71 to the intermediate roller pair 54. Besides, the first drive transmitting section 110 has a function not to transmit the driving force of the reversely-rotated first drive motor 71 to the first feeding roller 31. The forward rotation of the first drive motor 71 in the present embodiment corresponds to a normal rotation of the first drive motor in the present teaching, and the reverse rotation of the first drive motor 71 corresponds to a reverse rotation of the first drive motor in the present teaching.

<Second Drive Transmitting Section 120>

Figure 13:
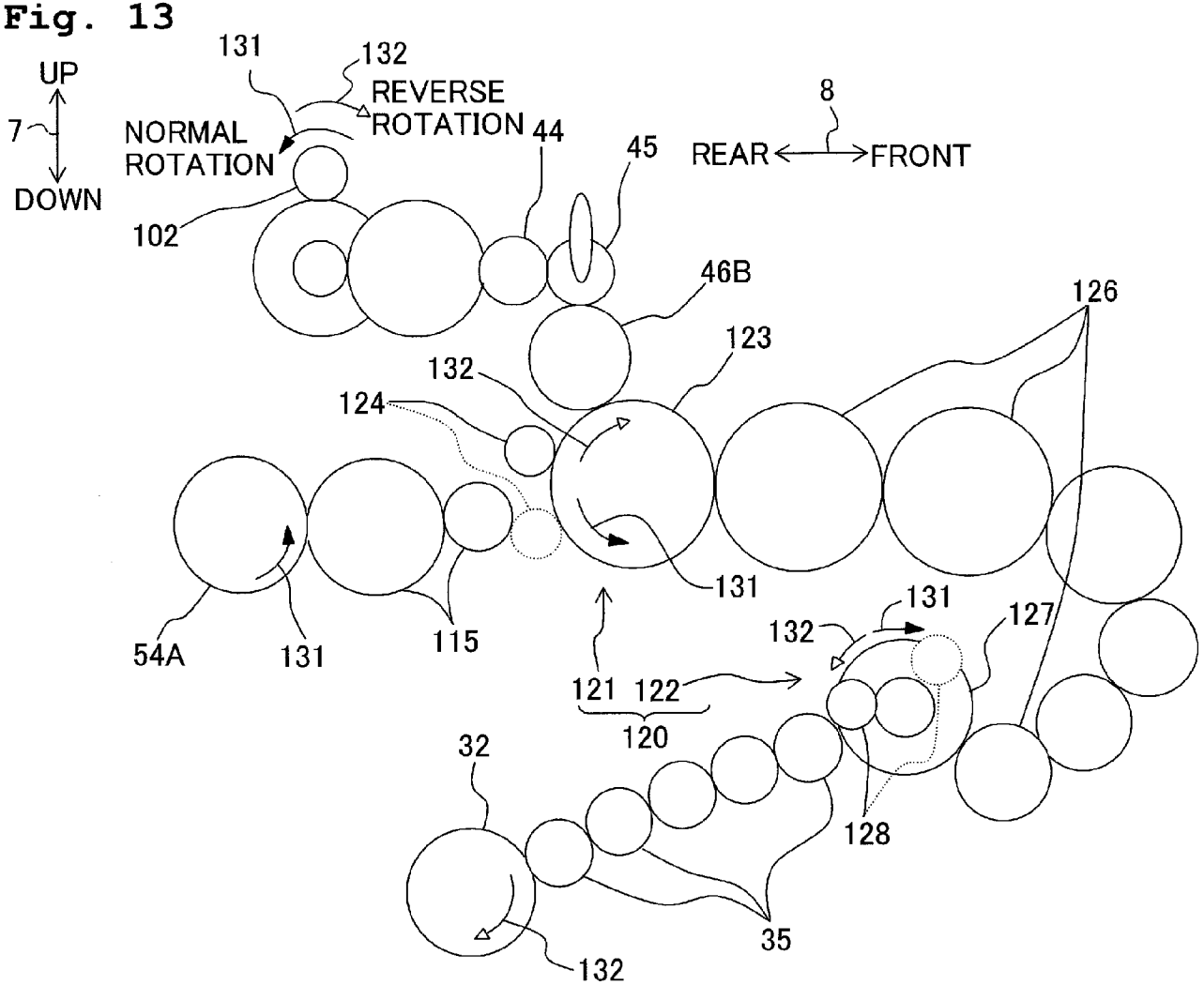
FIG. 13 is a schematic diagram of a second drive transmitting section.

As shown in FIG. 13, the second drive transmitting section 120 has a structure similar to that of the first drive transmitting section 110, and includes two planetary gear mechanisms of a third planetary gear mechanism 121 and a second planetary gear mechanism 122. Accordingly, the second drive transmitting section 120 has a function to transmit the driving force of the reversely-rotated (refer to the arrow mark 132) first drive motor 71 to the second feeding roller 32 and to transmit the driving force of the normally-rotated (refer to the arrow mark 131) first drive motor 71 to the intermediate roller pair 54, and at the same time, it has a function not to transmit the driving force of the forwardly-rotated first drive motor 71 to the second feeding roller 32.

<Detecting Mechanism>

A detecting mechanism includes: a first sensor 81 and a second sensor 82 shown in FIG. 2; and a first encoder 83 and a second encoder 84 shown in FIG. 9. The first sensor 81 is disposed on an upstream side of the intermediate roller pair 54 in the transport direction 38. The second sensor 82 is disposed on an upstream side of the main transporting roller pair 55 in the transport direction 38.

The first sensor 81 and the second sensor 82 are so-called register sensors, and a structure thereof is well known. For example, each of the first sensor 81 and the second sensor 82 is formed of a light-emitting diode, a photodiode, and a detector provided in a removable manner to the main transport route 51, and an output during when the paper 5 passes through the sensor is different from an output when the paper 5 does not pass through the sensor. In the description hereinbelow, the outputs of the first sensor 81 and the second sensor 82 during when the paper 5 passes through the sensors are defined as first outputs, and the outputs thereof when the paper 5 does not pass through the sensors are defined as second outputs. The first sensor 81 corresponds to a first detecting section in the present teaching, and the second sensor 82 corresponds to a second detecting section in the present teaching. Further, the first output corresponds to a first output and a third output in the present teaching, and the second output corresponds to a second output and a fourth output in the present teaching.

The encoders 83 and 84 have a structure similar to that of well-known encoders. For example, each of the encoders 83 and 84 includes a light-emitting diode, a photodiode and a disk, in which a light-transmitting portion that transmits light and a light-shielding portion that shields light are provided to the disk. When the disk rotates, the light-transmitting portion and the light-shielding portion alternately pass over an optical path of the light-emitting diode, and an output of the photodiode changes. The disk is attached to shafts of the drive motors 71 and 72, rotary shafts rotated by the drive motors 71 and 72, and the like. The first encoder 83 is provided to the first drive motor 71 in an attached manner. The second encoder 84 is provided to the second drive motor 72 in an attached manner.

As shown in FIG. 9, the control section 90 includes: a first counter 91 counting a change in an output of the first encoder 83; a second counter 92 counting a change in an output of the second encoder 84; and a memory (a storage section) 94.

The memory 94 stores first to fourth predetermined values. The first predetermined value is a threshold value regarding a count value of the first counter 91, and is set as a value indicating that at least a predetermined rotation amount is obtained after a tip of the paper 5 that has passed through the first sensor 81 reaches the intermediate roller pair 54. The second predetermined value is a threshold value regarding a count value of the first counter 91, and is set as a value indicating that at least a predetermined rotation amount is obtained after the tip of the paper 5 reaches the main transporting roller pair 55. Note that the tip of the paper 5 means a tip of the paper 5 in the transport direction 38. The third predetermined value is a threshold value regarding a count value of the first counter 91, and is a value for judging that the tip of the paper 5 reaches the main transporting roller pair 55. The fourth predetermined value is a threshold value regarding a count value of the second counter 92, and is a value that determines a start of feeding of the paper 5. The fourth predetermined value is, for example, externally input as image data to be stored in the memory 94.

<Operation of Control Section 90>

Figure 6A:
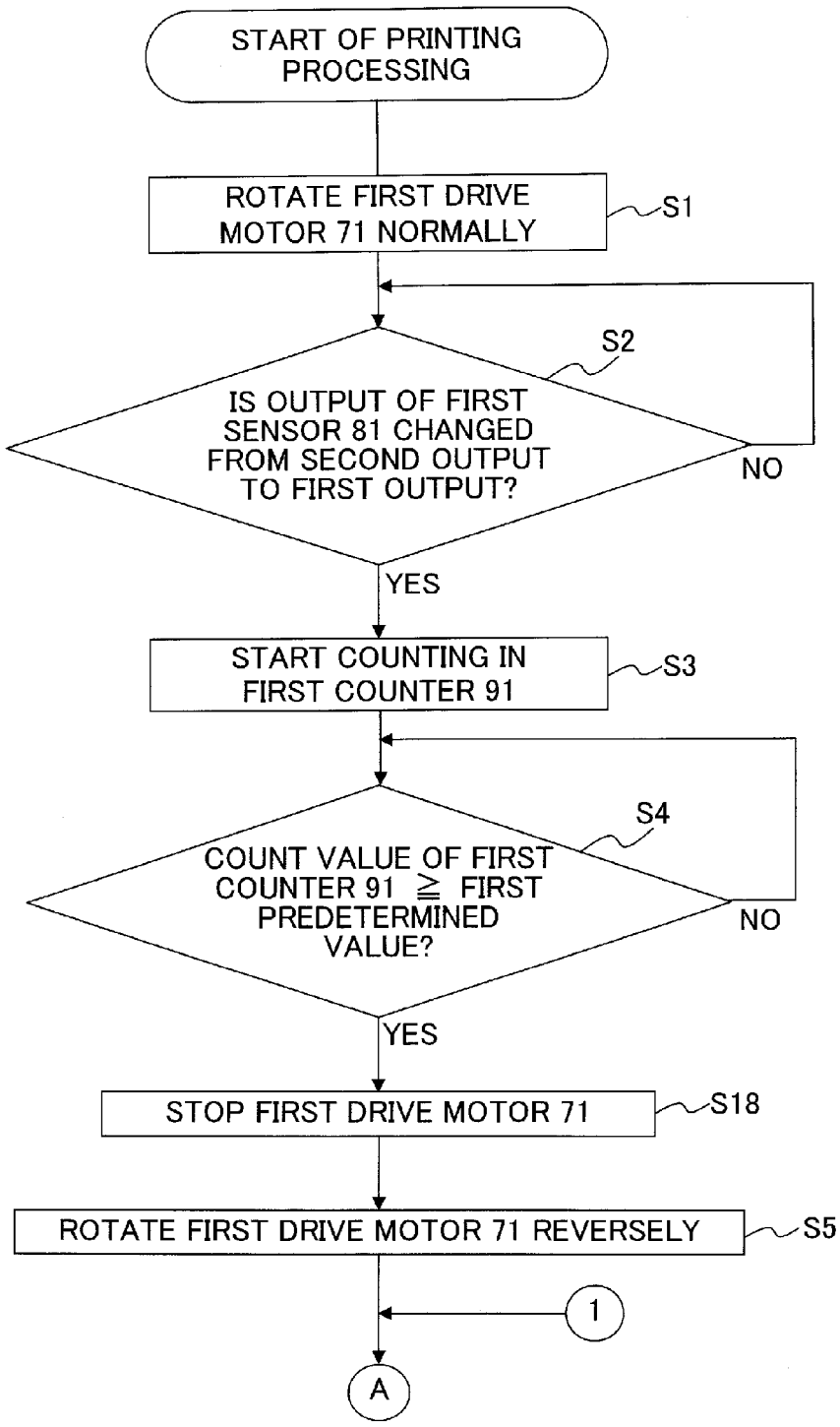
FIGS. 6A, 6B and 6C are flow charts of printing processing in a first recording mode.
Figure 6B:
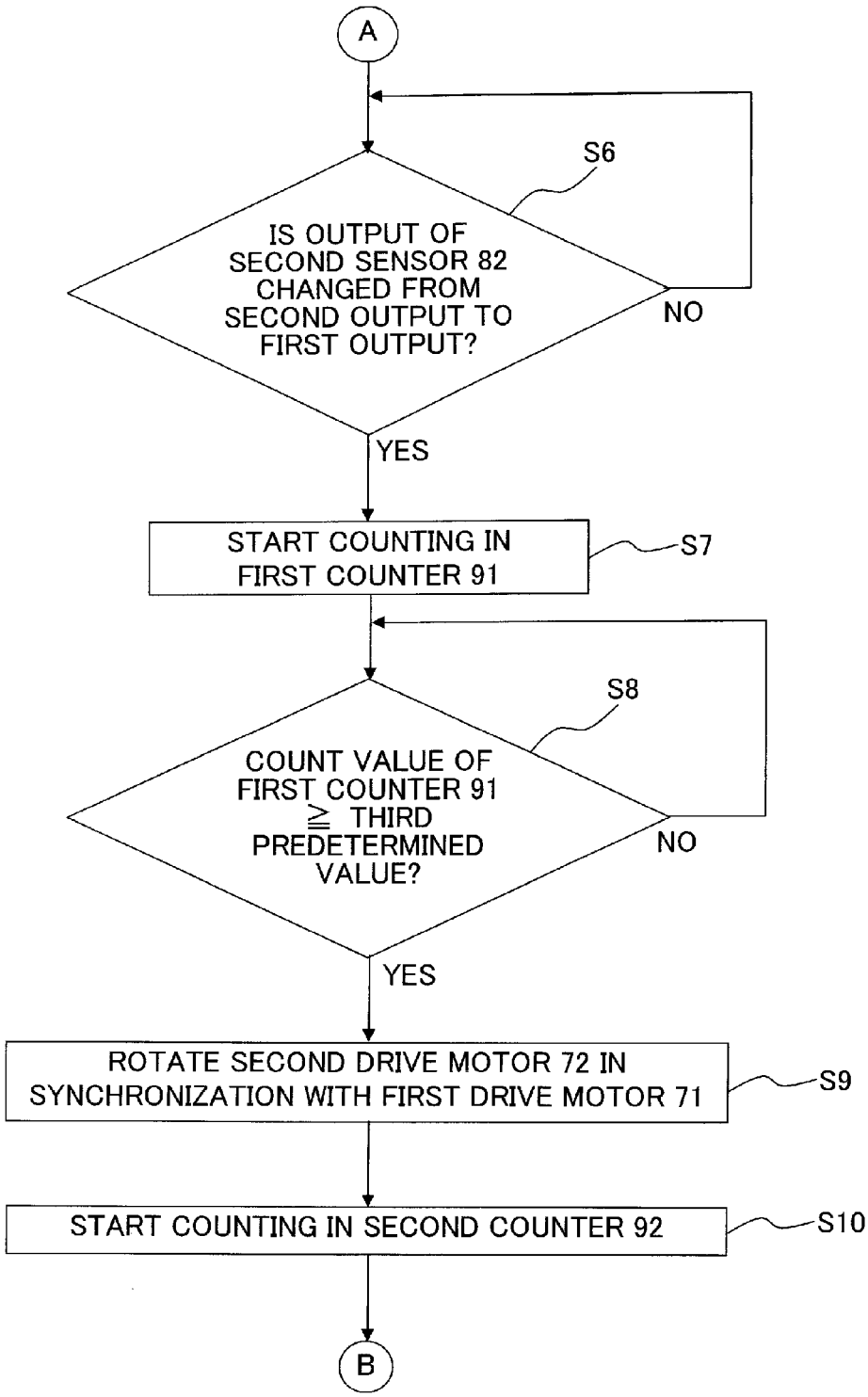
Figure 6C:
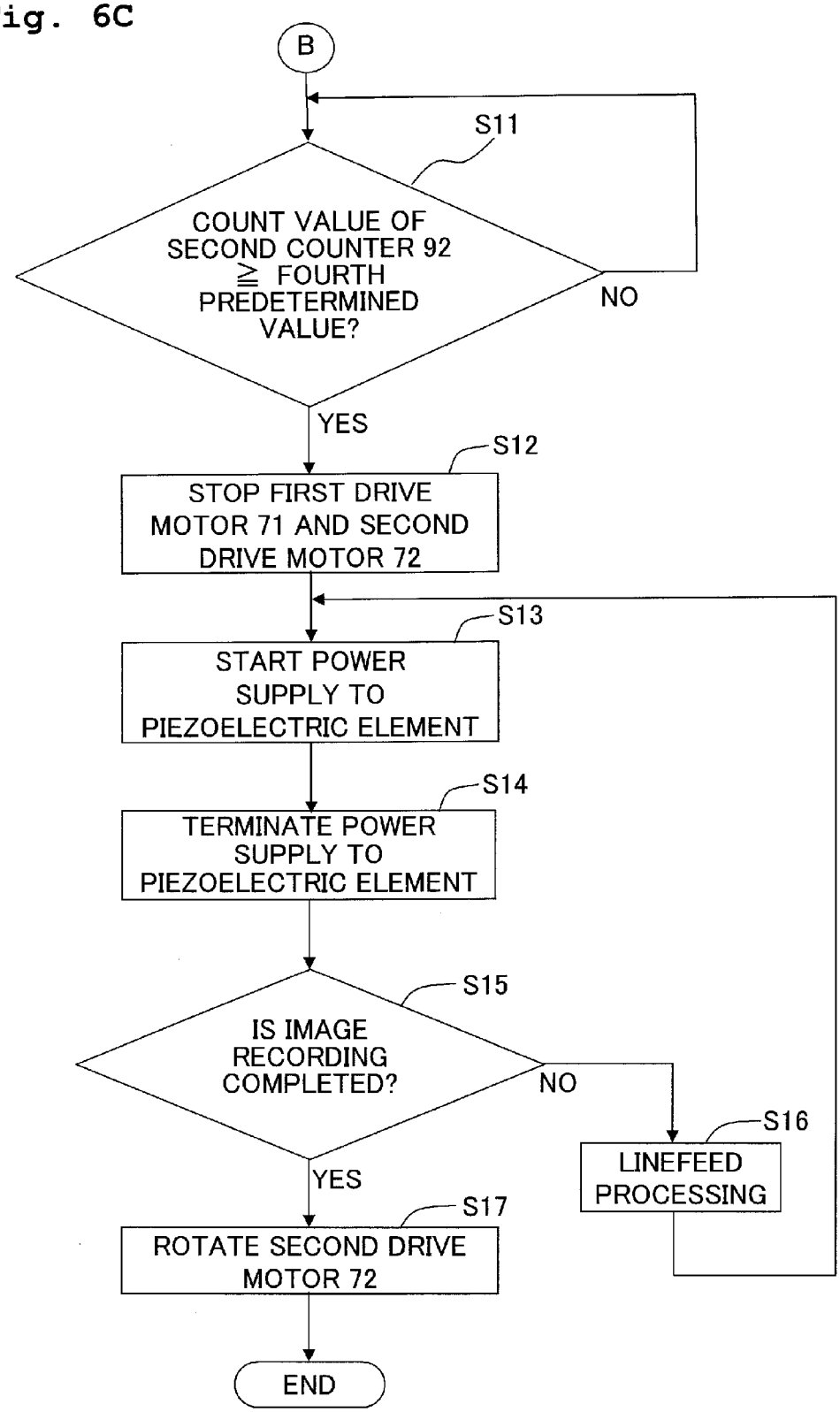
Figure 7A:
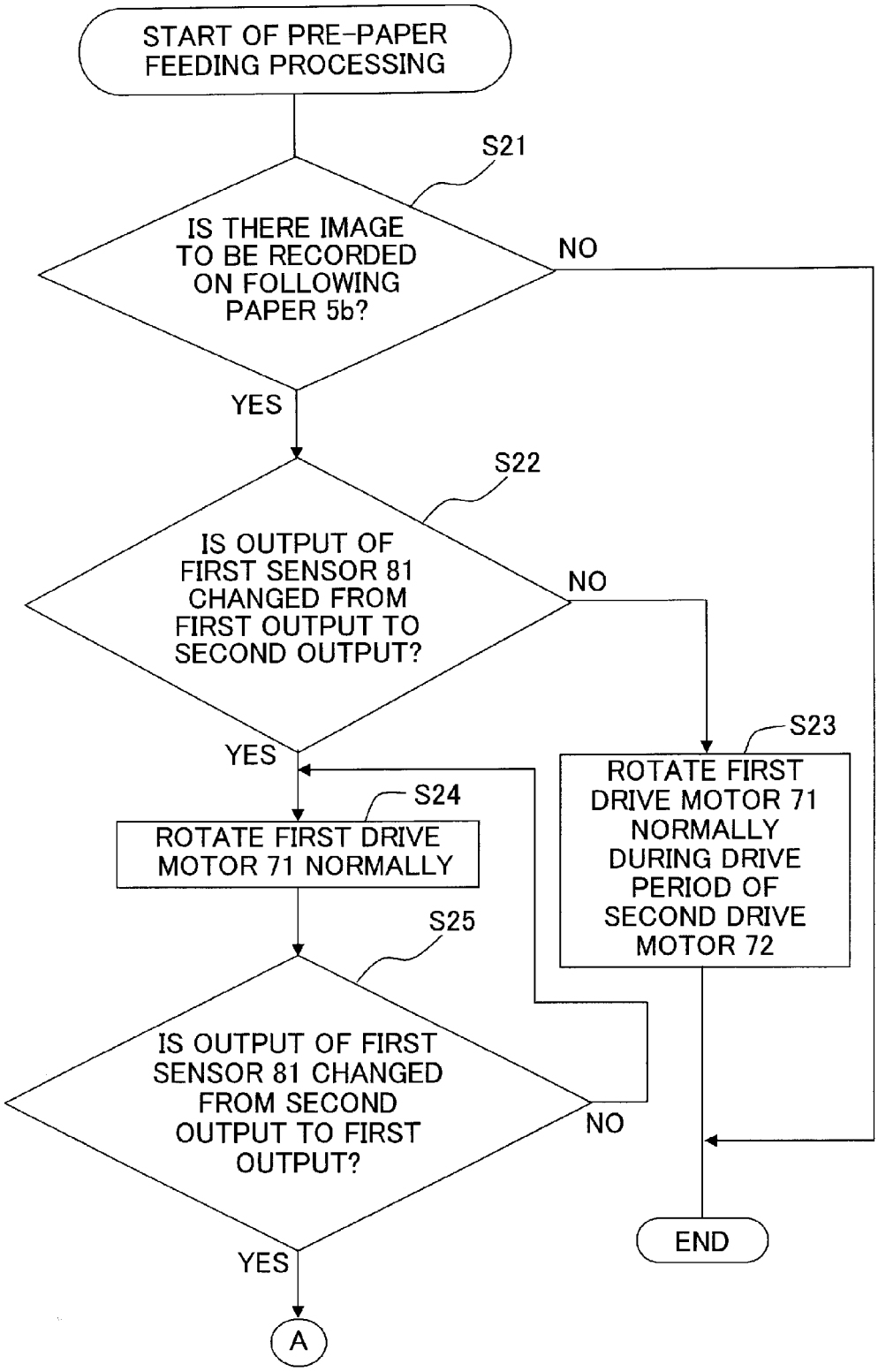
FIGS. 7A and 7B are flow charts of pre-paper feeding processing in the first recording mode.
Figure 7B:
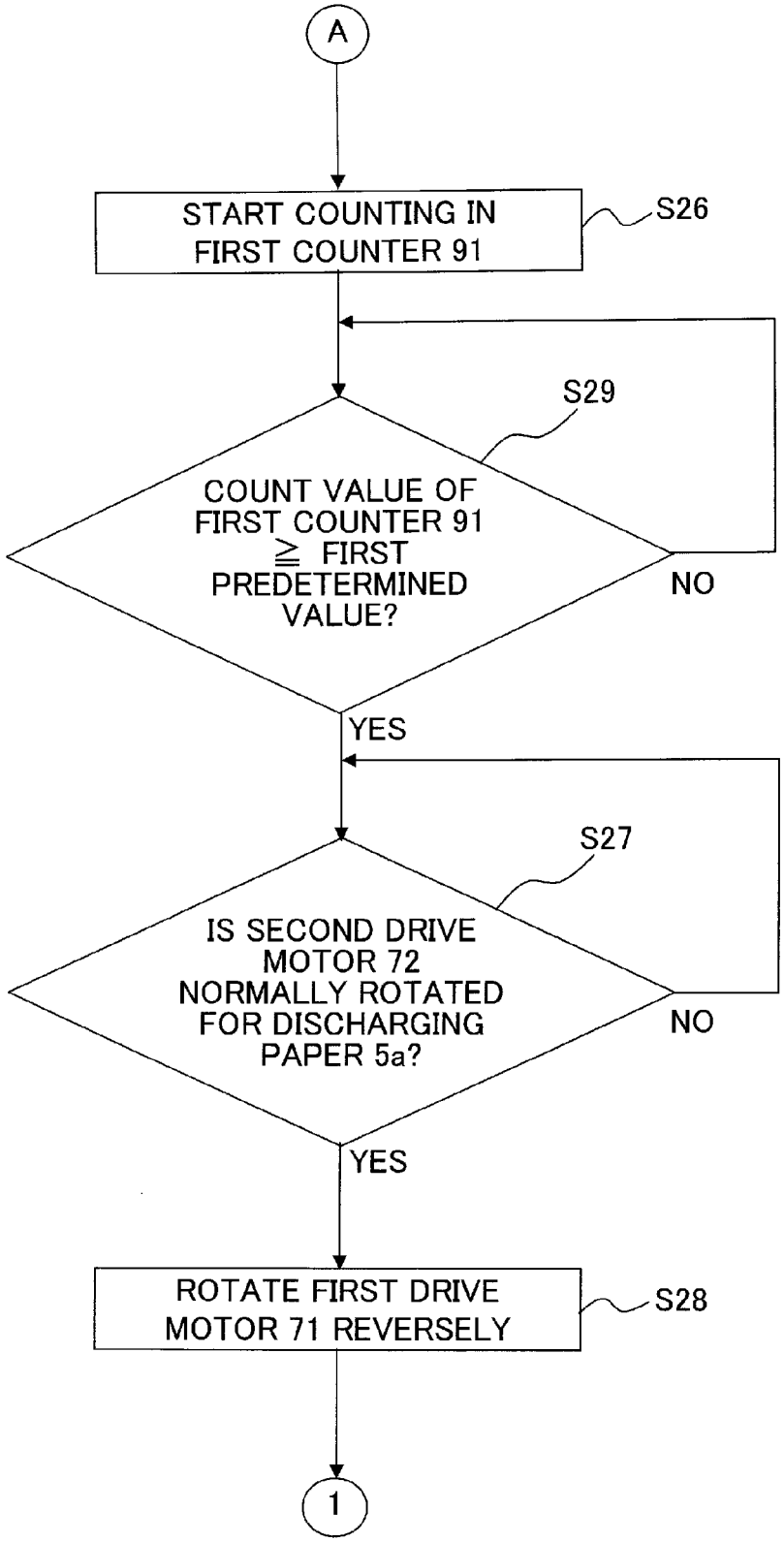
Figure 8A:
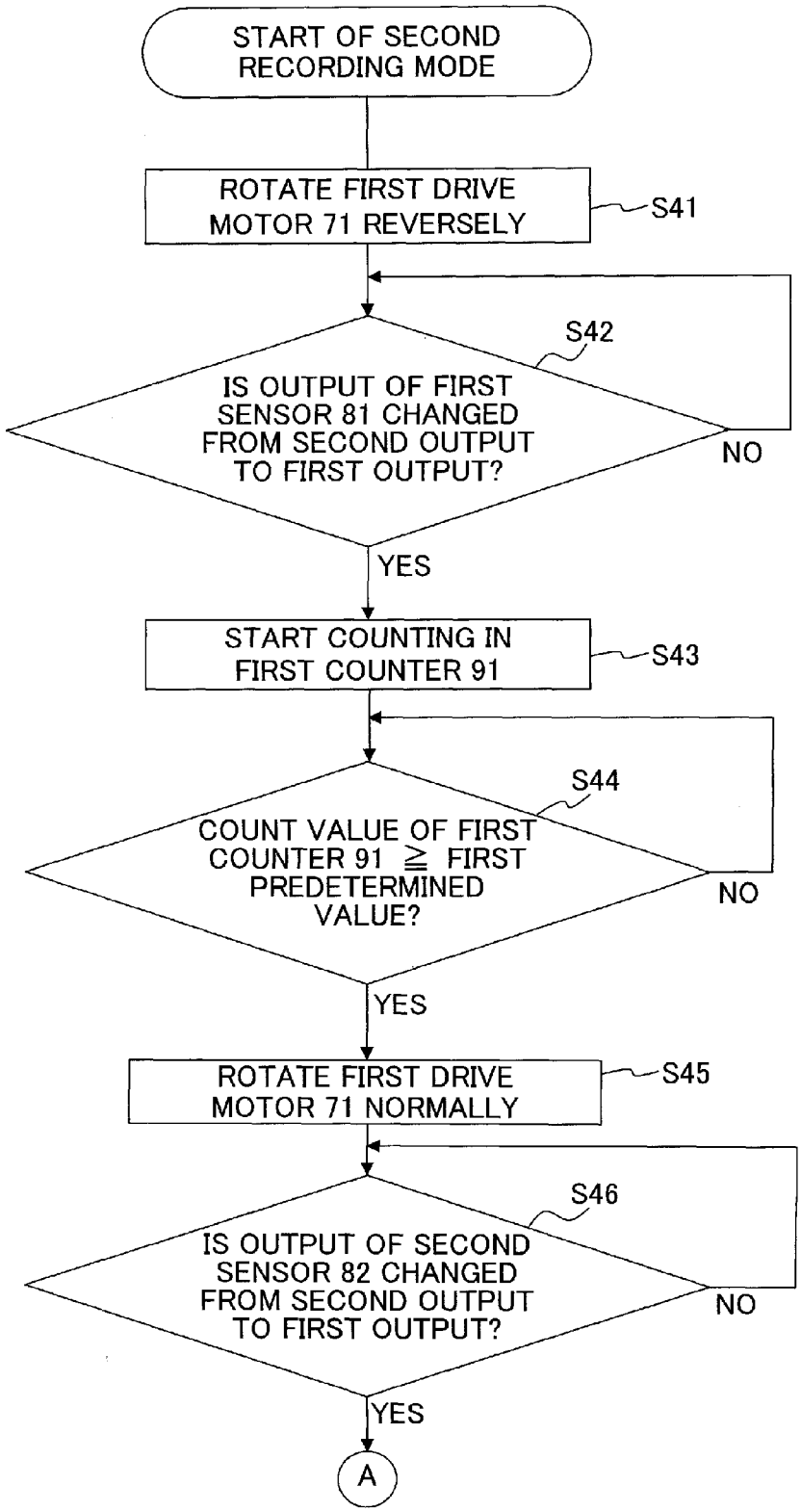
FIGS. 8A, 8B and 8C are flow charts of a second recording mode.
Figure 8B:
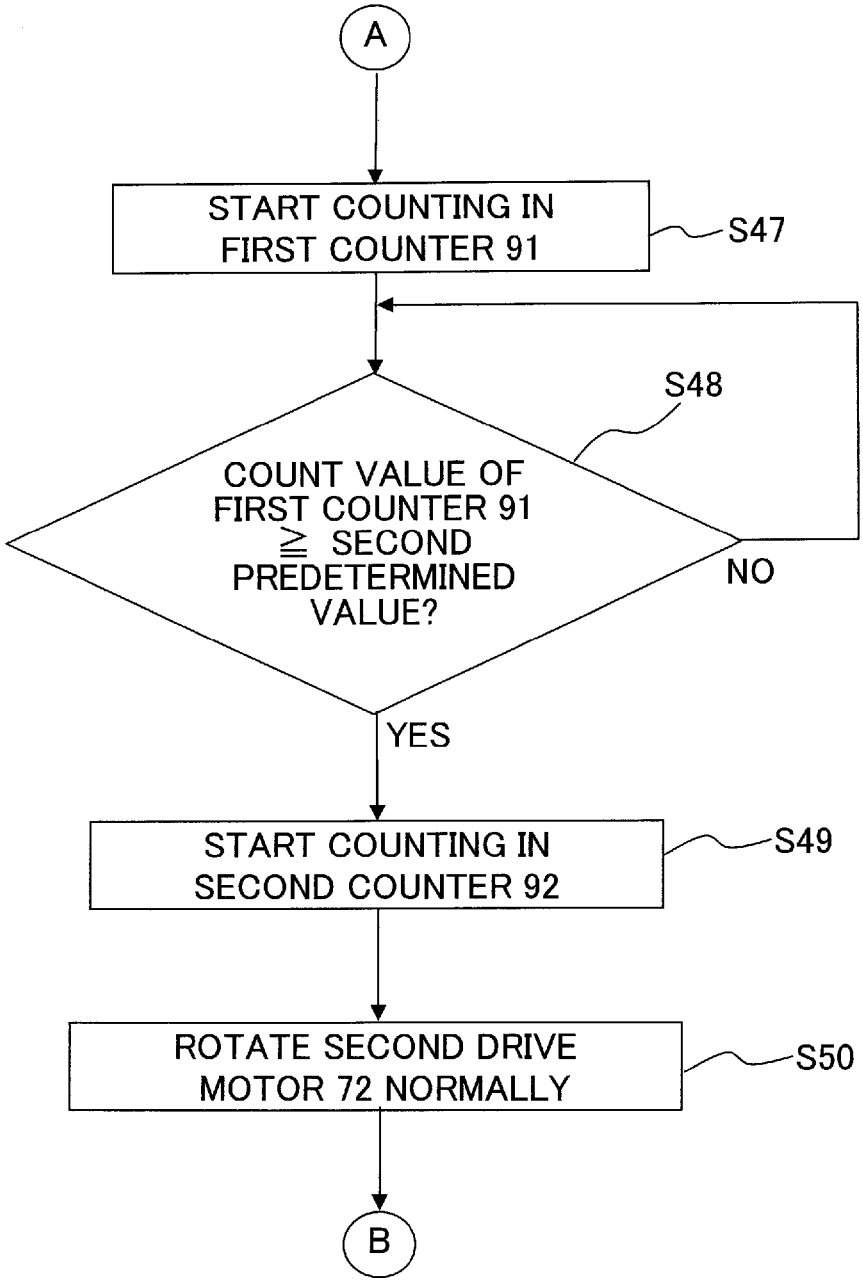
Figure 8C:
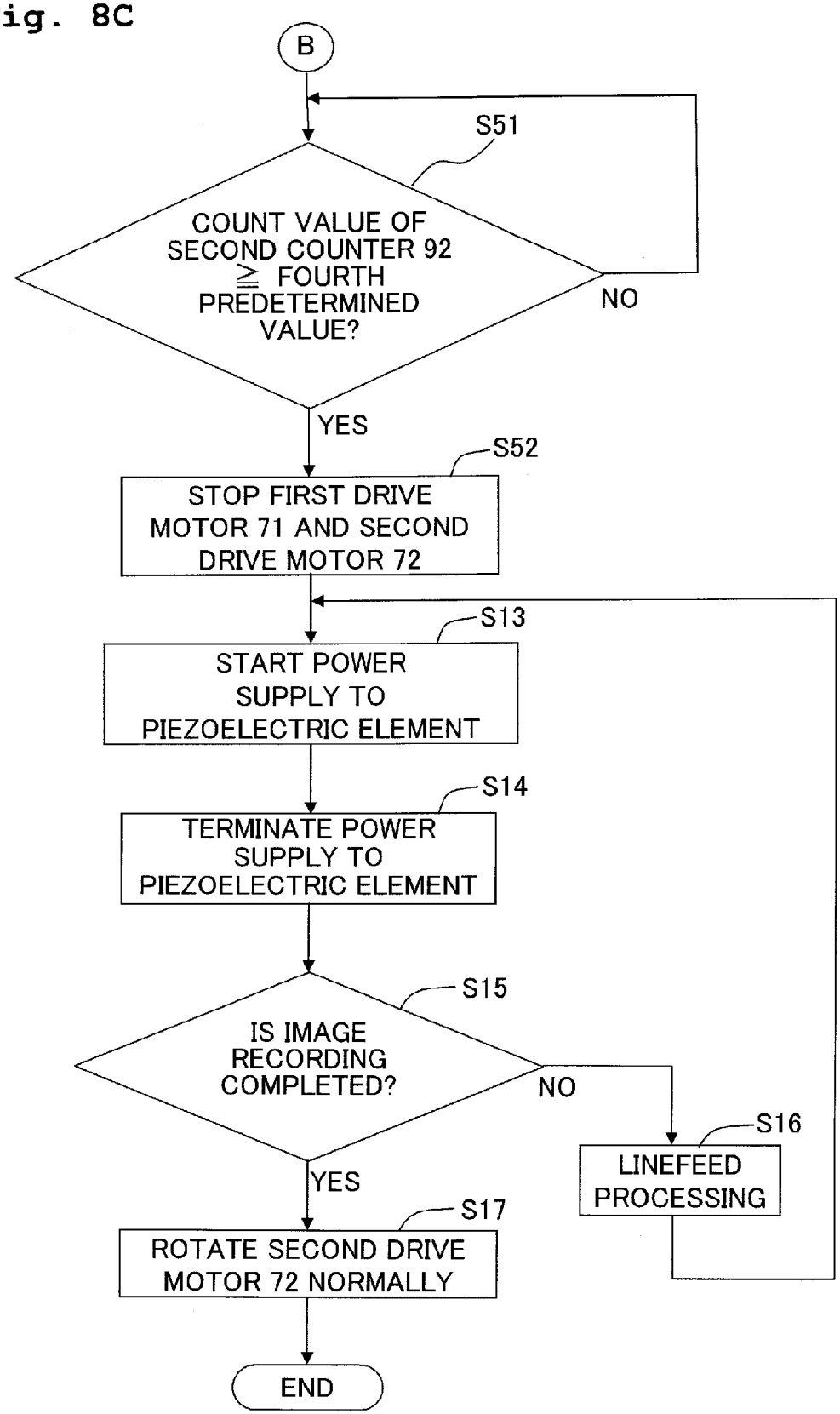

The control section 90 has a first recording mode shown in FIGS. 6 and 7, and a second recording mode shown in FIG. 8. In the first recording mode, the control section 90 conducts printing processing shown in FIG. 6 and pre-paper feeding processing shown in FIG. 7. The first recording mode corresponds to a first recording mode in the present teaching, the second recording mode corresponds to a second recording mode in the present teaching, and the pre-paper feeding processing corresponds to pre-paper feeding processing in the present teaching. Hereinafter, the operation of the control section 90 will be described with reference to FIGS. 6 to 11.

<First Recording Mode>

When the control section 90 receives a printing instruction in accordance with the first recording mode, it drives the third drive motor 73 to move the carriage 23, and changes the posture of the switching gear 45 to the first posture. Further, after putting the first receiving gear 46A in a drivable state, the control section 90 performs the printing processing in FIG. 6.

Figure 10A:
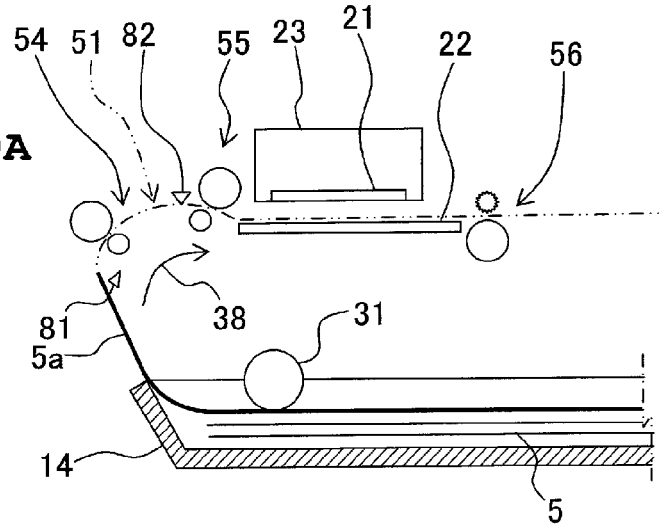
FIGS. 10A, 10B and 10C are explanatory diagrams explaining operations of the multifunction machine 10.
Figure 10B:
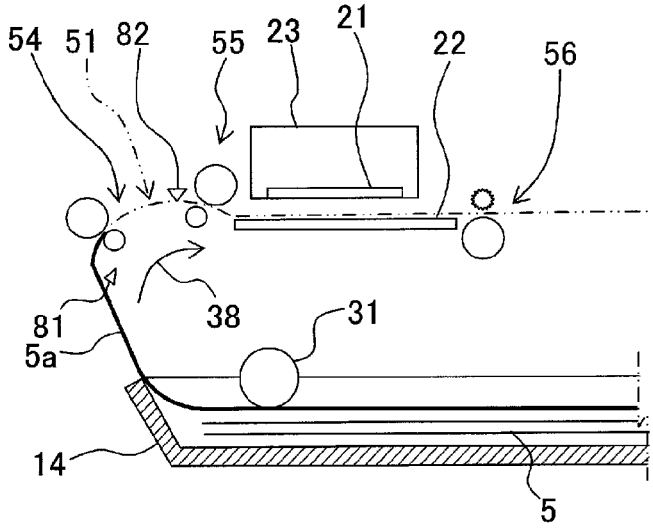
Figure 10C:
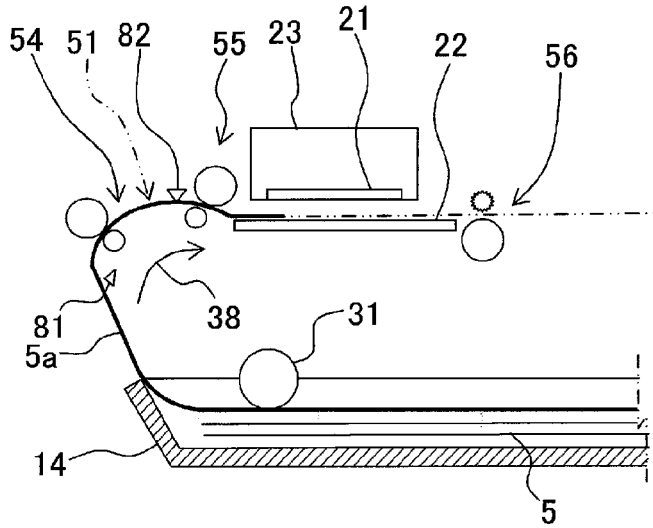
Figure 11A:
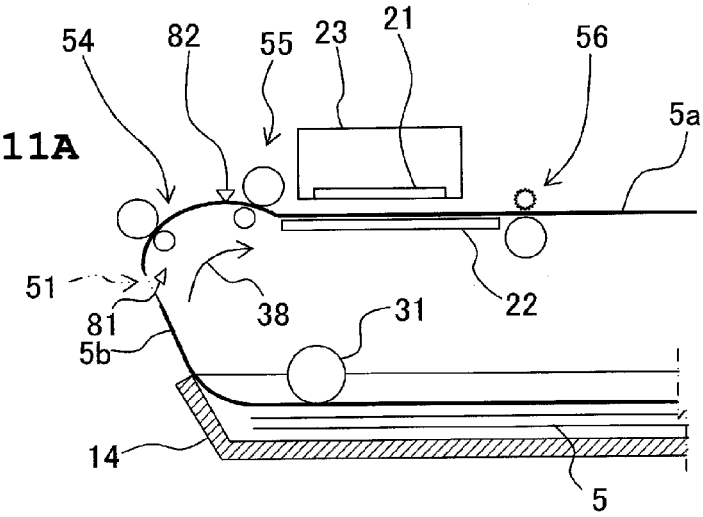
FIGS. 11A, 11B and 11C are explanatory diagrams explaining operations of the multifunction machine 10.
Figure 11B:
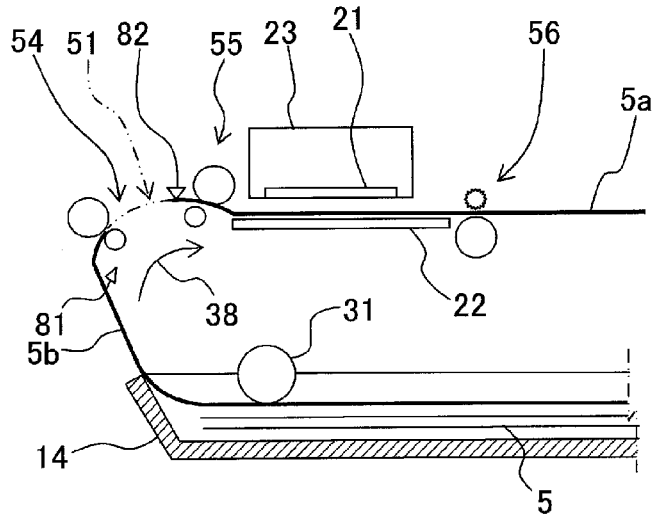
Figure 11C:
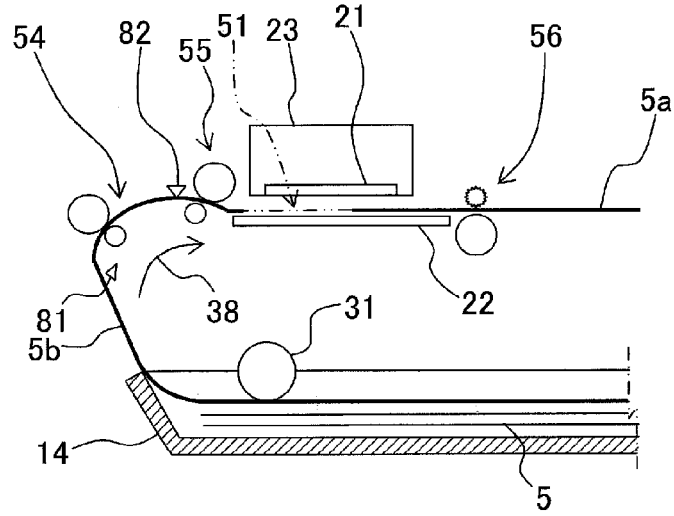

In the printing processing in FIGS. 6A to 6C, the control section 90 controls the driving section 70 so that the first drive motor 71 is rotated forwardly to rotate the first feeding roller 31 (S1), and that a paper 5*a* from the upper tray 14 is fed to the main transport route 51 (refer to FIG. 10A). Next, when the control section 90 detects that the output of the first sensor 81 is changed from the second output to the first output because of the fed paper 5*a* (S2, Y), the control section 90 starts counting in the first counter 91 (S3). The control section 90 controls the driving section 70 so as to keep feeding the paper 5*a* until when the count value of the first counter 91 becomes the first predetermined value and the paper 5*a* abuts on the intermediate roller pair 54 (refer to FIG. 10(B)). Accordingly, the paper 5*a* is abutted on the intermediate roller pair 54 and a skew thereof is corrected, and is then transported toward the main transporting roller pair 55. When the control section 90 judges that the count value of the first counter 91 becomes the first predetermined value (S4, Y), it once stops the driving of the first drive motor 71 (S18). Thereafter, the control section 90 controls the driving section 70 so that the first drive motor 71 is reversely rotated to rotate the intermediate roller pair 54 (S5), and that the paper 5*a* is transported toward the main transporting roller pair 55 (refer to FIG. 10C). The aforementioned processing for conducting register correction using the intermediate roller pair 54 corresponds to first skew correction processing in the present teaching.

When the control section 90 judges that the output of the second sensor 82 is changed from the second output to the first output because of the paper 5*a* transported by the intermediate roller pair 54 (S6, Y), the control section 90 starts counting in the first counter 91 (S7). Further, when the control section 90 judges that a tip of the paper 5*a* reaches the main transporting roller pair 55 based on the fact that the count value of the first counter 91 becomes the third predetermined value (S8, Y), the control section 90 controls the driving section 70 so that the second drive motor 72 is forwardly rotated in synchronization with the first drive motor 71 (S9), and that the paper 5*a* is transported toward a side of the recording head 21 using the main transporting roller pair 55. Then, the control section 90 starts counting in the second counter 92 (S10). The "synchronization" means to make the first drive motor 71 and the second drive motor 72 rotate in the transport direction 38 and in the direction in which the paper 5*a* is transported and, at the same time, to make them have the same angular acceleration and angular speed. Alternatively, the "synchronization" means to make the first drive motor 71 and the second drive motor 72 rotate while differentiating the angular acceleration and the angular speed by a predetermined amount.

When the control section 90 judges that the start of feeding is completed based on the fact that the count value of the second counter 92 becomes the fourth predetermined value (S11, Y) (refer to FIG. 10C), the control section 90 controls the driving section 70 to stop the first drive motor 71 and the second drive motor 72 (S12), and at the same time, the control section 90 starts the supply of power to the piezoelectric element (S13) to make the recording head 21 jet ink. After finishing jetting ink by the recording head 21 (S14), the control section 90 judges whether the image recording is completed (S15). When the control section 90 judges that the image recording is not completed (S15, N), the control section 90 conducts linefeed processing for rotating the second drive motor 72 by a predetermined amount (S16). In the linefeed processing in step S16, the control section 90 drives the first drive motor 71 and the second drive motor 72 in a synchronous manner, by reversely rotating the first drive motor 71 and normally rotating the second drive motor 72. The control section 90 alternately performs the linefeed processing (S16) and the jetting of ink (S13, S14), thereby recording an image on a surface of the paper 5*a*. Specifically, the control section 90 controls the driving section 70 and the recording head 21 so that the paper 5*a* is transported intermittently, and that the ink is jetted from the recording head 21 during when the paper 5*a* is stopped. When the control section 90 judges that the image recording is completed (S15, Y), the control section 90 controls the driving section 70 so that the second drive motor 72 is rotated normally to discharge the paper 5*a* to the paper discharge tray 16 (S17).

In the aforementioned linefeed processing, when the control section 90 judges that a rear end of the paper 5*a* in the transport direction 38 reaches the first sensor 81 based on the fact that the output of the first sensor 81 is changed from the first output to the second output, or when the control section 90 judges that the rear end of the paper 5*a* has passed through the intermediate roller pair 54 based on the count value of the first counter 91, the control section 90 stops the driving of the first drive motor 71. Specifically, the first drive motor 71 and the second drive motor 72 are driven in a synchronous manner until when the rear end of the paper 5*a* reaches the first sensor 81 or until when the rear end of the paper 5*a* has passed through the intermediate roller pair 54. The paper 5*a* is first transported by being nipped between each of the intermediate roller pair 54 and the main transporting roller pair 55. When the tip of the paper 5*a* reaches the paper discharge roller pair 56, the paper is transported by being nipped between each of the intermediate roller pair 54, the main transporting roller pair 55 and the paper discharge roller pair 56, and when the rear end of the paper 5*a* has passed through the intermediate roller pair 54, the paper is transported by being nipped between each of the main transporting roller pair 55 and the paper discharge roller pair 56.

<Pre-Paper Feeding Processing>

The pre-paper feeding processing in FIG. 7 is carried out in the linefeed processing in step S16 in FIG. 6. The control section 90 judges whether or not there is an image to be recorded on the following paper 5*b* (S21). When there is no image to be recorded on the following paper 5*b* (S21, N), the control section 90 terminates the pre-paper feeding processing. When there is the image to be recorded on the following paper 5*b* (S21, Y), the control section 90 judges whether or not an end of the precedently fed paper 5*a* reaches the first sensor 81 based on the fact that the output of the first sensor 81 is changed from the first output to the second output (S22). When the end of the precedently fed paper 5*a* does not reach the first sensor 81 (S22, N), the control section 90 controls the driving section 70 so that the first drive motor 71 is rotated normally during a drive period of the second drive motor 72 (S23), and the control section 90 terminates the pre-paper feeding processing. At this time, when the rear end of the precedently fed paper 5*a* has already passed through the first paper feeding roller 31, the following paper 5*b* is fed (refer to FIG. 11(A)). Further, since a transporting force of the first paper feeding roller 31 is smaller than a transporting force of the main transporting roller pair 55, even when the rear end of the precedently fed paper 5*a* has not yet passed through the first paper feeding roller 31, it is possible to transport the paper 5*b* with the use of the main transporting roller pair 55. Here, the transporting force is determined by a nip force and a frictional force of each of the rollers with respect to the paper 5. In addition, the number of rotations or a time of rotation of the first drive motor 71 is set so that a feeding amount of the paper 5*b* fed by the first feeding roller 31 becomes smaller than a linefeed width in the linefeed processing. Further, a rotational speed of the first drive motor 71 is set at a constant ratio so that it becomes smaller than a rotational speed of the second drive motor 72 in the aforementioned linefeed processing. Therefore, there is no chance that a tip of the paper 5*b* fed in the pre-paper feeding processing abuts on the rear end of the precedently fed paper 5*a*, and it is possible to detect the rear end of the precedently fed paper 5*a* using the first sensor 81. Further, since the first feeding roller 31 is intermittently rotated, overlapping papers 5*b* are separated to be fed to the main transport route 51. Note that the driving of the second drive motor 72 can also be conducted in all of a plurality of drive periods of the third drive motor 73, or can also be conducted selectively (in the third, fifth and seventh drive periods, for example).

Therefore, when the rear end of the precedently fed paper 5*a* has not yet passed through the first sensor 81, and until when the output of the first sensor 81 is changed from the first output to the second output, the first drive motor 71 is normally rotated during the drive period of the second drive motor 72 in the linefeed processing in step S16. Accordingly, it is possible to feed the paper 5*b* to be fed later during when the recording is performed on the precedently fed paper 5*a*.

Next, when the control section 90 judges, in step S22, that the rear end of the precedently fed paper 5*a* reaches the first sensor 81 based on the fact that the output of the first sensor 81 is changed from the first output to the second output (S22, Y), the control section 90 controls the driving section 70 to rotate the first drive motor 71 forwardly (S24). The control section 90 judges whether or not the tip of the later-fed paper 5*b* reaches the first sensor 81 based on whether or not the output of the first sensor 81 is changed from the second output to the first output (S25). When the control section 90 judges that the tip of the paper 5*b* does not reach the first sensor 81 (S25, N), the control section 90 continuously conducts the forward rotation of the first drive motor 71. When the control section 90 judges that the tip of the paper 5*b* reaches the first sensor 81 (S25, Y), the control section 90 starts counting in the first counter 91 (S26), continuously conducts the forward rotation of the first drive motor 71 until when the control section 90 judges that the count value of the first counter 91 becomes the first predetermined value (S29, N), and performs register correction using the intermediate roller pair 54 (refer to FIG. 11(B)). When the control section 90 judges, in step S29, that the count value of the first counter 91 becomes the first predetermined value (S29, Y), and besides, when the control section 90 judges that the second drive motor 72 is forwardly rotated for discharging the precedently fed paper 5*a* (S27, Y), the control section 90 controls the driving section 70 so that the first drive motor 71 rotates reversely, and that the paper 5*b* which is made on standby at the intermediate roller pair 54 is transported toward the main transporting roller pair 55 (S28). Specifically, a start of feeding of the later-fed paper 5*b* is conducted in conjunction with a discharge operation of the precedently fed paper 5*a* (refer to FIG. 11(C)). The control section 90 performs, after step S28, processings in step S6 and thereafter.

<Second Recording Mode>

When the control section 90 receives a printing instruction in accordance with the second recording mode, the control section 90 drives the third drive motor 73 to move the carriage 23, changes the posture of the switching gear 45 to the second posture, and after putting the second receiving gear 46B in a drivable state, it performs the processing in FIG. 8.

The control section 90 performs control (S41 to S47) similar to that of the aforementioned step S1 to step S7, and conducts register correction using the intermediate roller pair 54. Note that in step S41, the first drive motor 71 is reversely rotated, and in step S45, the first drive motor 71 is normally rotated. Thereafter, when the control section 90 judges that the count value of the first counter 91 becomes the second predetermined value (S48, Y), the control section 90 starts counting in the second counter 92 (S49), and at the same time, the control section 90 controls the second drive motor 72 to rotate normally (S50). Specifically, in the second recording mode, the register correction is performed by using the main transporting roller pair 55, too. The aforementioned processing for conducting the register correction using the main transporting roller pair 55 corresponds to second skew correction processing in the present teaching.

When the control section 90 judges that the start of feeding is completed based on the fact that the count value of the second counter 92 becomes the fourth predetermined value (S51, Y), the control section 90 stops the driving of the first drive motor 71 and the second drive motor 72 to conduct the start of feeding (S52), and thereafter, the control section 90 performs the aforementioned step S13 to step S16 to conduct the linefeed and the jetting of ink. When the control section 90 judges that the image recording is completed (S15, Y), the control section 90 controls the driving section 70 so that the second drive motor 72 is rotated normally to discharge the paper 5 (S17).

Note that in the above description, so-called static register correction in which the main transporting roller pair 55 which preliminarily remains stationary is rotated in the normal direction in the second recording mode is explained, but, it is also possible to adopt a structure in which the skew of the paper 5 is corrected using so-called reverse register correction in which the main transporting roller pair 55 that is rotated in the reverse direction preliminarily is rotated in the normal direction. Further, it is also possible to correct the skew of the paper 5 using so-called return register correction in which the tip of the paper 5 is once passed through the main transporting roller pair 55, and thereafter, the main transporting roller pair 55 is reversely rotated to make the tip of the paper 5 abut on the main transporting roller pair 55.

Further, in the present embodiment, it is designed such that the pre-paper feeding processing is carried out during the drive period of the second drive motor 72 in the linefeed processing in step S16 and the first drive motor 71 is normally rotated, but, it is also possible to design such that the pre-paper feeding is carried out during when the image is recorded on the precedently transported paper 5*a* in a period of time in which the second drive motor 72 is stopped, and the first drive motor 71 is normally rotated.

Further, in the present embodiment, a structure in which the image is recorded on the paper 5 mounted on the upper tray 14 when the first recording mode is carried out, and the image is recorded on the paper 5 mounted on the lower tray 15 when the second recording mode is carried out, is explained. The present teaching is not limited to such a structure. For instance, it is also possible to adopt a structure in which the image is recorded on the paper 5 mounted on the lower tray 15 when the first recording mode is carried out, and the image is recorded on the paper 5 mounted on the upper tray 14 when the second recording mode is carried out, and it is also possible to adopt a structure in which either the first recording mode or the second recording mode is selected and executed by a user in both trays of the upper tray 14 and the lower tray 15.

Further, in the present embodiment, the multifunction machine 10 that performs single-sided printing is explained, but, it is also possible to apply the present invention to a multifunction machine capable of performing double-sided printing by providing a reverse transport route having a well-known structure.

Further, in the present embodiment, a structure in which, in conjunction with the discharge operation of the precedently fed paper 5*a*, the paper 5*b* which is fed next is transported toward the main transporting roller pair 55 is explained, but, it is also possible to adopt a structure in which, in conjunction with the linefeed processing of the precedently fed paper 5*a*, the paper 5*b* which is fed next is transported toward the main transporting roller pair 55. In this case, for example, the control section 90 sets a timing to start the transport of the paper 5*b* which is fed next using the intermediate roller pair 54, so that the rear end of the precedently fed paper 5*a* and a front end of the paper 5*b* which is fed next are separated by a certain distance. The certain distance is set to a distance at which the discharge of the precedently fed paper 5*a* and the start of feeding of the later-fed paper 5*b* are simultaneously completed, for example. The control section 90 determines the timing by, for example, detecting the rear end of the precedently fed paper 5*a* using the first sensor 81 and detecting a feeding amount of the precedently fed paper 5*a* based on the counter value of the first counter 91.

Further, in the present embodiment, a structure in which the first drive motor 71 and the second drive motor 72 are intermittently driven in a synchronous manner is explained, but, it is also possible to adopt a structure in which the first drive motor 71 is stopped and the paper 5 is transported by using only the second drive motor 72, and the start of feeding and the linefeed processing are conducted. In this case, it is also possible to execute the pre-paper feeding processing by normally rotating the first drive motor 71 during the drive period of the second drive motor 72, for instance.

When the control section 90 judges, in step S22, that the tip of the paper 5*b* reaches the first sensor 81 based on the fact that the output of the first sensor 81 is changed from the second output to the first output (S22, Y), the control section 90 controls the first drive motor 71 to rotate normally in step S23, but, it is also possible that when the control section 90 judges that the tip of the paper 5*b* reaches the first sensor 81 and the paper has passed through the intermediate roller pair 54 based on the counting of rotation amount of the counter and the like, the control section 90 controls the first drive motor 71 to rotate normally.

In the present embodiment, since the intermediate roller pair 54 is provided to the curved portion 51A, it is possible to transport the paper 5 to the main transporting roller pair 55 while reducing a radius of curvature of the curved portion 51A, resulting in that the multifunction machine 10 which is compact in size is realized.

Further, since the first drive motor 71 can drive, with the use of the drive transmission switching mechanism 40, four driving targets of the first feeding roller 31, the second feeding roller 32, the intermediate roller pair 54 and the maintenance mechanism, it is possible to reduce the number of drive motors to be used.

Further, in the first recording mode, during when the image is recorded on the precedently fed paper 5*a*, the feeding of the following paper 5*b* is started, the following paper 5*b* is pre-fed to a position right before the intermediate roller pair 54, and thereafter, the skew of the paper is corrected by conducting the register correction using the intermediate roller pair 54, and the following paper 5*b* is transported toward the recording head 21 in conjunction with the operation of transporting the precedently fed paper 5*a*. Accordingly, it is possible to eliminate a period of time required for the register correction, and at the same time, it is possible to practically reduce a transport distance to the recording head 21, resulting in that a period of time taken for the image recording can be reduced without lowering an accuracy of recording position in the image recording.

Further, in the aforementioned pre-paper feeding processing, the first feeding roller 31 or the second feeding roller 32 is intermittently driven at a slow speed, which enables to securely separate the overlapping papers 5.

Further, since the first feeding roller 31 is rotated only by the forward rotation of the first drive motor 71, and the second feeding roller 32 is rotated only by the reverse rotation of the first drive motor 71, even if wrong gear switching occurs, only the intermediate roller pair 54 is rotated, and there is no chance that the paper 5 is erroneously fed, resulting in that the occurrence of erroneous paper feeding caused by the wrong gear switching can be prevented.

Further, after feeding the paper 5 to the main transport route 51, the intermediate roller pair 54 can be driven only by changing the direction of rotation of the second drive motor 72, and no gear switching is conducted during the transport of the paper 5, resulting in that a multifunction machine 10 in which no paper jam due to the wrong gear switching occurs, is realized.

Further, in the second recording mode, the intermediate roller pair 54 and the main transporting roller pair 55 are driven in a synchronous manner, so that an effect of the curved portion 51A on the transport of the paper 5 can be reduced, resulting in that there is realized a multifunction machine 10 which is compact in size and capable of performing image recording with high accuracy. Further, in the second recording mode, the multifunction machine 10 performs two times of register correction, in total, using each of the intermediate roller pair 54 and the main transporting roller pair 55, to thereby further enhance the accuracy of the image recording.

What is claimed is:

1. An image recording apparatus which jets an ink to record an image on sheet-shaped recording media, comprising:

a first mounting section on which the sheet-shaped recording media are mounted;

a first feeding roller which feeds one recording medium of the sheet-shaped recording media from the first mounting section;

a first transporting roller pair which nips the recording medium fed by the first feeding roller to transport the recording medium in a transport direction;

a second transporting roller pair which is provided on a downstream side of the first transporting roller pair in the transport direction, and which nips and transports the recording medium transported by the first transporting roller pair;

a recording head which is provided on a downstream side of the second transporting roller pair in the transport direction and which jets the ink onto the recording medium transported by the second transporting roller pair;

a first detecting section which is provided on an upstream side of the first transporting roller pair in the transport direction, wherein the first detecting section is configured to detect the recording medium passing through thereof and to output a first output when the recording medium passes through the first detecting section and a second output when the recording medium does not pass through the first detecting section;

a driving section which drives the first feeding roller, the first transporting roller pair and the second transporting roller pair; and a controller which controls the driving section and the recording head to execute a first recording mode in which the first transporting roller pair is rotated in synchronization with a rotation of the second transporting roller pair, wherein the controller is configured to perform a plurality kinds of processing, comprising:

a recording processing in which the controller controls the driving section to drive the second transporting roller pair intermittently and controls the recording head to jet the ink during a period of time in which the second transporting roller pair is stopped;

a pre-paper feeding processing in which, during the recording processing, the controller controls the driving section so that the first feeding roller is rotated a predetermined amount in a paper feeding direction until the output of the first detecting section is changed from the first output to the second output and that a tip of a following recording medium is fed to an upstream side of the first detecting section; and a first skew correction processing in which the controller controls the driving section to rotate the first feeding roller to make the following recording medium abut on the first transporting roller pair, under a condition that the output of the first detecting section is changed from the first output to the second output, wherein the driving section comprises:

a first drive motor which is configured to rotate in a normal direction and a reverse direction;

a second drive motor which drives the second transporting roller pair; and a first drive transmitting section which transmits a rotation of the first drive motor that is normally rotated to the first feeding roller so that the first feeding roller rotates in a direction in which the recording medium is fed, which transmits a rotation of the first drive motor that is reversely rotated to the first transporting roller pair, and which prevents transmitting the rotation of the first drive motor that is reversely rotated to the first feeding roller.

2. The image recording apparatus according to claim 1, wherein the predetermined amount is set to a rotation amount of the first feeding roller with which the following recording medium does not reach the first detecting section in the pre-paper feeding processing using the first feeding roller under a condition that the sheet-shaped recording media are mounted at the maximum on the mounting section.

3. The image recording apparatus according to claim 1, wherein the controller starts execution of the pre-paper feeding processing when the second transporting roller pair is driven in one time of the intermittent driving of the second transporting roller pair in the recording processing.

4. The image recording apparatus according to claim 3, wherein the controller executes the pre-paper feeding processing for each of the intermittent driving of the second transporting roller pair in the recording processing, and a rotation amount of the feeding roller in one time of the intermittent driving is smaller than a rotation amount in one time of the intermittent driving of the second transporting roller pair.

5. The image recording apparatus according to claim 4, wherein the controller sets a rotational speed of the first feeding roller to be smaller than a speed of the second transporting roller pair in the pre-paper feeding processing.

6. The image recording apparatus according to claim 1, wherein, in the first recording mode, the controller controls the driving section so that the following recording medium is on standby in a state of being abutted on the first transporting roller pair until the jetting of the ink by the recording head onto the recording medium for performing the image recording is completed, and under a condition that the jetting of the ink by the recording head onto the recording medium for performing the image recording is completed, the controller controls the drive section so that the second transporting roller pair is rotated to discharge the recording medium and that the first transporting roller pair is rotated to transport the following recording medium to a recording start position of the recording head.

7. The image recording apparatus according to claim 1, further comprising a second detecting section which is provided on a downstream side of the first transporting roller pair in the transport direction and on an upstream side of the second transporting roller pair in the transport direction and which outputs a third output during when the recording medium passes through the second detecting section and outputs a fourth output during when the recording medium does not pass through the second detecting section, wherein the controller is configured to execute a second recording mode in which the second transporting roller pair is normally rotated to transport the recording medium toward the recording head after executing a second skew correction processing in which the controller controls the driving section to rotate the first transporting roller pair to make the following recording medium abut on the second transporting roller pair, under a condition that the output of the second detecting section is changed from the third output to the fourth output.

8. The image recording apparatus according to claim 1, wherein a transport route having a curved portion is formed on the image recording apparatus; and the first transporting roller pair is provided to the curved portion.

9. The image recording apparatus according to claim 1, further comprising:

a second mounting section on which the sheet-shaped recording media is mounted;

a second feeding roller which feeds one recording medium of the sheet-shaped recording media from the second mounting section; and a drive transmission switching mechanism which transmits a driving of the first drive motor to one of the second feeding roller, the first feeding roller and the first transporting roller pair, wherein the drive transmission switching mechanism comprises:

a first gear rotated by the first drive motor;

a second gear which is disposed so that a rotation axis thereof becomes parallel to a rotation axis of the first gear and which is configured to move along a rotation axis direction in which the rotation axis extends, which changes its posture to a first posture and a second posture while moving in the rotation axis direction, and which engages with the first gear in the first and second posture;

a third gear which engages with the second gear in the first posture;

a fourth gear which engages with the second gear in the second posture; and a second drive transmitting section which transmits a rotation of the fourth gear rotated by the reverse rotation of the first drive motor to the second feeding roller, which transmits the rotation of the fourth gear rotated by the normal rotation of the first drive motor to the first transporting roller pair, and which prevents transmitting of the rotation of the fourth gear to the second feeding roller, wherein the first drive transmitting section further transmits a rotation of the third gear rotated by the forward rotation of the first drive motor to the first feeding roller, transmits the rotation of the third gear rotated by the reverse rotation of the first drive motor to the first transporting roller pair, and prevents transmitting of the rotation of the third gear to the first feeding roller.

10. The image recording apparatus according to claim 1, wherein a transporting force of the second transporting roller pair determined by a nip force and a frictional force of the second transporting roller pair with respect to the recording medium is larger than a transporting force of the first feeding roller.

11. An image recording apparatus configured to record an image on sheet-shaped recording media, comprising:

a mount section configured to receive the sheet-shaped recording media;

a feed roller configured to feed the sheet-shaped recording media from the mount section;

a first transporting roller pair configured to nip the sheet-shaped recording media fed by the feed roller to transport the sheet-shaped recording media in a transport direction;

a second transporting roller pair which is provided in a downstream side of the first transporting roller pair in the transport direction, and is configured to nip and to transport the sheet-shaped recording media transported by the first transporting roller pair;

a recording head which is provided on a downstream side of the second transporting roller pair in the transport direction and is configured to record an image in the transport direction and is configured to record an image onto the sheet-shaped recording media transported by the second transporting roller pair;

a first drive motor configured to supply a first driving force to the feed roller and the first transporting roller pair; and a second drive motor configured to supply a second driving force to the second transporting roller pair;

wherein, when the first drive motor rotates in a first direction, the feed roller rotates and feeds the sheet-shaped recording media and the first driving force of the first drive motor is not supplied with the first transporting roller pair, wherein, when the first drive motor rotates in a second direction opposed to the first direction, the first transporting roller pair rotates and feeds the sheet-shaped recording media and the first driving force of the first drive motor is not supplied with the feed roller.

12. The image recording apparatus according to claim 11, wherein the first transporting roller pair is configured to perform a skew correction for the sheet-shaped recording media.

13. An image recording apparatus configured to record an image on sheet-shaped recording media, comprising:

a mount section capable of receiving the sheet-shaped recording media;

a feed roller capable of feeding the sheet-shaped recording media from the mount section;

a first transporting roller pair capable of nipping the sheet-shaped recording media fed by the feed roller to transport the sheet-shaped recording media in a transport direction;

a second transporting roller pair which is provided on a downstream side of the first transporting roller pair in the transport direction, and being capable of nipping and transporting the sheet-shaped recording media transported by the first transporting roller pair;

a recording head which is provided on a downstream side of the second transporting roller pair in the transport direction and capable of recording an image onto the sheet-shaped recording media transported by the second transporting roller pair;

a first drive motor capable of supplying a first driving force to the feed roller and the first transporting roller pair; and a second drive motor capable of supplying a second driving force to the second transporting roller pair;

wherein, when the first drive motor rotates in a first direction, the feed roller rotates and feeds the sheet-shaped recording media and the first driving force of the first drive motor is not supplied to the first transporting roller pair, wherein, when the first drive motor rotates in a second direction opposed to the first direction, the first transporting roller pair rotates and feeds the sheet-shaped recording media and the first driving force of the first drive motor is not supplied to the feed roller.

14. The image recording apparatus according to claim 13, wherein the first transporting roller pair is capable of performing a skew correction for the sheet-shaped recording media.

* * * * *